US011183012B2

(12) United States Patent
Eager et al.

(10) Patent No.: US 11,183,012 B2
(45) Date of Patent: Nov. 23, 2021

(54) SYSTEMS AND METHODS OF AUTOMATED LINKING OF PLAYERS AND GAMING TOKENS

(71) Applicant: SG Gaming, Inc., Las Vegas, NV (US)

(72) Inventors: Terrin Eager, Campbell, CA (US); Bryan Kelly, Alamo, CA (US); Martin S. Lyons, Henderson, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/943,128

(22) Filed: Jul. 30, 2020

(65) Prior Publication Data

US 2021/0056804 A1 Feb. 25, 2021

Related U.S. Application Data

(60) Provisional application No. 62/888,708, filed on Aug. 19, 2019.

(51) Int. Cl.
*G07F 17/32* (2006.01)

(52) U.S. Cl.
CPC ..... *G07F 17/3239* (2013.01); *G07F 17/322* (2013.01); *G07F 17/3241* (2013.01)

(58) Field of Classification Search
CPC ..... G07F 17/3239; G07F 17/322; G07F 17/3241; G07F 17/3232; G07F 17/3237; G07F 17/3234
See application file for complete search history.

(56) References Cited

U.S. PATENT DOCUMENTS

| | | | | |
|---|---|---|---|---|
| 5,103,081 | A | 4/1992 | Fisher et al. | |
| 5,451,054 | A | 9/1995 | Orenstein | |
| 5,757,876 | A | 5/1998 | Dam et al. | |
| 5,870,493 | A * | 2/1999 | Vogl | G06K 9/4628 382/195 |
| 6,460,848 | B1 | 10/2002 | Soltys et al. | |
| 6,514,140 | B1 | 2/2003 | Storch | |
| 6,517,435 | B2 | 2/2003 | Soltys et al. | |
| 6,517,436 | B2 | 2/2003 | Soltys et al. | |
| 6,520,857 | B2 | 2/2003 | Soltys et al. | |
| 6,527,271 | B2 | 3/2003 | Soltys et al. | |
| 6,530,836 | B2 | 3/2003 | Soltys et al. | |
| 6,530,837 | B2 | 3/2003 | Soltys et al. | |
| 6,533,276 | B2 | 3/2003 | Soltys et al. | |

(Continued)

OTHER PUBLICATIONS

US 10,854,041 B2, 12/2020, Shigeta (withdrawn)

*Primary Examiner* — Jasson H Yoo

(57) ABSTRACT

A system including an image sensor that captures image data of a gaming table and a player area, and a tracking controller communicatively coupled to the image sensor. The tracking controller detects a player and a token set from the captured image data by applying an image neural network model to the image data to generate at least one key player data element for the player and at least one key token data element for the token set, generates a player data object representing physical characteristics of the player based on the key player data elements, links the player data object to a player identifier of the player, generates a token identifier based on the key token data elements, and links the token identifier to the player data object based on a physical relationship between the player and the token set indicated by the key data elements.

19 Claims, 15 Drawing Sheets

(56) References Cited

U.S. PATENT DOCUMENTS 6,533,662 B2 3/2003 Soltys et al.
6,579,180 B2 6/2003 Soltys et al.
6,579,181 B2 6/2003 Soltys et al.
6,595,857 B2 7/2003 Soltys et al.
6,663,490 B2 12/2003 Soltys et al.
6,688,979 B2 2/2004 Soltys et al.
6,712,696 B2 3/2004 Soltys et al.
6,758,751 B2 7/2004 Soltys et al.
7,011,309 B2 3/2006 Soltys et al.
7,124,947 B2 10/2006 Storch
7,316,615 B2 1/2008 Soltys et al.
7,753,781 B2 7/2010 Storch
7,771,272 B2 8/2010 Soltys et al.
8,130,097 B2 3/2012 Knust et al.
8,285,034 B2 10/2012 Rajaraman et al.
8,606,002 B2 12/2013 Rajaraman et al.
8,896,444 B1 11/2014 Knust et al.
9,165,420 B1 10/2015 Knust et al.
9,174,114 B1 11/2015 Knust et al.
9,378,605 B2 6/2016 Koyama
9,511,275 B1 12/2016 Knust et al.
9,795,870 B2 10/2017 Ratliff
9,889,371 B1 2/2018 Knust et al.
10,032,335 B2 7/2018 Shigeta
10,096,206 B2 10/2018 Bulzacki et al.
10,192,085 B2 1/2019 Shigeta
10,242,525 B1 3/2019 Knust et al.
10,242,527 B2 3/2019 Bulzacki et al.
10,380,838 B2 8/2019 Bulzacki et al.
10,398,202 B2 9/2019 Shigeta
10,403,090 B2 9/2019 Shigeta
10,410,066 B2 9/2019 Bulzacki et al.
10,493,357 B2 12/2019 Shigeta
10,529,183 B2 1/2020 Shigeta
10,540,846 B2 1/2020 Shigeta
10,580,254 B2 3/2020 Shigeta
10,593,154 B2 3/2020 Shigeta
10,600,279 B2 3/2020 Shigeta
10,600,282 B2 3/2020 Shigeta
10,665,054 B2 5/2020 Shigeta
10,706,675 B2 7/2020 Shigeta
10,720,013 B2 7/2020 Main, Jr.
10,741,019 B2 8/2020 Shigeta
10,748,378 B2 8/2020 Shigeta
10,755,524 B2 8/2020 Shigeta
10,755,525 B2 8/2020 Shigeta
10,762,745 B2 9/2020 Shigeta
10,825,288 B1 11/2020 Knust et al.
10,832,517 B2 11/2020 Bulzacki et al.
10,846,980 B2 11/2020 French et al.
10,846,985 B2 11/2020 Shigeta
10,846,986 B2 11/2020 Shigeta
10,846,987 B2 11/2020 Shigeta
2005/0059479 A1 3/2005 Soltys et al.
2006/0019739 A1 1/2006 Soltys et al.
2006/0177109 A1* 8/2006 Storch ..... A63F 1/00 382/118
2009/0118022 A1* 5/2009 Lyons ..... G06Q 30/0255 463/42
2010/0093429 A1* 4/2010 Mattice ..... G07F 17/3232 463/25
2018/0053377 A1 2/2018 Shigeta
2018/0061178 A1 3/2018 Shigeta
2018/0068525 A1 3/2018 Shigeta
2018/0075698 A1 3/2018 Shigeta
2018/0114406 A1 4/2018 Shigeta
2018/0211110 A1 7/2018 Shigeta
2018/0211472 A1 7/2018 Shigeta
2018/0232987 A1 8/2018 Shigeta
2018/0239984 A1 8/2018 Shigeta
2018/0336757 A1 11/2018 Shigeta
2019/0043309 A1 2/2019 Shigeta
2019/0088082 A1 3/2019 Shigeta
2019/0102987 A1 4/2019 Shigeta
2019/0147689 A1 5/2019 Shigeta
2019/0172312 A1 6/2019 Shigeta
2019/0188957 A1 6/2019 Bulzacki et al.
2019/0188958 A1 6/2019 Shigeta
2019/0236891 A1 8/2019 Shigeta
2019/0259238 A1 8/2019 Shigeta
2019/0266832 A1 8/2019 Shigeta
2019/0318576 A1 10/2019 Shigeta
2019/0320768 A1 10/2019 Shigeta
2019/0333322 A1 10/2019 Shigeta
2019/0333323 A1 10/2019 Shigeta
2019/0333326 A1 10/2019 Shigeta
2019/0340873 A1* 11/2019 Shigeta ..... G07F 17/3241
2019/0344157 A1 11/2019 Shigeta
2019/0347893 A1 11/2019 Shigeta
2019/0347894 A1 11/2019 Shigeta
2019/0362594 A1 11/2019 Shigeta
2019/0371112 A1 12/2019 Shigeta
2020/0034629 A1 1/2020 Vo et al.
2020/0035060 A1 1/2020 Shigeta
2020/0118390 A1 4/2020 Shigeta
2020/0122018 A1 4/2020 Shigeta
2020/0175806 A1 6/2020 Shigeta
2020/0202134 A1 6/2020 Bulzacki et al.
2020/0226878 A1 7/2020 Shigeta
2020/0234464 A1 7/2020 Shigeta
2020/0242888 A1 7/2020 Shigeta
2020/0258351 A1 8/2020 Shigeta
2020/0265672 A1 8/2020 Shigeta
2020/0273289 A1 8/2020 Shigeta
2020/0294346 A1 9/2020 Shigeta
2020/0302168 A1 9/2020 Vo et al.
2020/0342281 A1 10/2020 Shigeta
2020/0349806 A1 11/2020 Shigeta
2020/0349807 A1 11/2020 Shigeta
2020/0349808 A1 11/2020 Shigeta
2020/0349809 A1 11/2020 Shigeta
2020/0349810 A1 11/2020 Shigeta
2020/0349811 A1 11/2020 Shigeta
2020/0364979 A1 11/2020 Shigeta
2020/0372746 A1 11/2020 Shigeta
2020/0372752 A1 11/2020 Shigeta

* cited by examiner

500

600

SYSTEMS AND METHODS OF AUTOMATED LINKING OF PLAYERS AND GAMING TOKENS

CROSS-REFERENCE TO RELATED APPLICATIONS

This application claims the benefit of priority of U.S. Provisional Patent Application Ser. No. 62/888,708, filed Aug. 19, 2019, the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2020, Scientific Games International, Inc.

FIELD OF THE INVENTION

The present invention relates generally to gaming systems, apparatus, and methods and, more particularly, to image analysis of gaming environments for establishing links between players and gaming elements, such as tokens or gaming devices.

BACKGROUND

Casino gaming environments are dynamic environments in which the actions of players and/or casino operators may affect subsequent actions, the state of the gaming environment, and/or the state of the player. For example, a player may be associated with one or more tokens that are used to place wagers on a wagering game. Based on the outcome of the placed wagers, a credit balance of the player as represented by the remaining tokens held by the player may change, which may influence subsequent wagers by the player. A multitude of other changes may occur at any given time. To effectively manage such a dynamic environment, the casino operators may employ one or more tracking systems or techniques to monitor aspects of the casino gaming environment, such as credit balance, player account information, and the like. The tracking systems may generate a historical record of these monitored aspects to enable the casino operators to facilitate, for example, a secure gaming environment, enhanced game features, and/or enhanced player features (e.g., rewards and benefits to known players with a player account).

At least some of the tracking systems may be used to monitor games with a plurality of players in which each player may place a respective wager. For example, the tracking systems may be used to monitor card-based games at a casino gaming table. The tracking systems may monitor one or more aspects of the card-based game to aid a dealer in tracking game progression, enforcing rules, and/or managing payouts. However, at least some known tracking systems may be limited in their ability to monitor the game because the tracking systems are configured to monitor specific, predetermined areas of the casino table. The predetermined areas are used to provide context to the data collected by the tracking systems, such as which player placed a wager. In instances in which back-betting (also referred to herein as "back wagers") is allowed, the players may not be limited to the seats or other predetermined areas of the casino gaming table, which may reduce the effectiveness of these known tracking systems in providing accurate data and may potentially create security issues in which unmonitored back wagers are provided using fake tokens.

Accordingly, a new tracking system that is adaptable to the dynamic nature of casino gaming environments is desired.

SUMMARY

According to one aspect of the present disclosure, system for tracking players and tokens in a casino gaming environment is provided. The system including at least one image sensor that captures image data of a gaming table and a player area associated with the gaming table, and a tracking controller communicatively coupled to the image sensor to receive the captured image data. The tracking controller detects a player occupying the player area and a token set from the captured image data at least by applying at least one image neural network model to the captured image data to generate at least one key player data element for the player and to generate at least one key token data element for the token set, generates a player data object representing physical characteristics of the player based on the key player data elements, links the player data object to a player identifier associated with the player, generates a token identifier for the detected token set based on the key token data elements, and links the token identifier to the player data object based on a physical relationship between the player and the token set indicated by the key player data elements and the key token data elements.

According to another aspect of the disclosure, a method for tracking players and tokens in a casino gaming environment is provided. The method includes capturing, by an image sensor, image data of a gaming table and a player area associated with the gaming table, receiving, by a tracking controller, the captured image data from the image sensor, detecting, by the tracking controller, a player occupying the player area and a token set from the captured image data at least by applying at least one image neural network model to the captured image data to generate at least one key player data element for the player and to generate at least one key token data element for the token set, generating a player data object representing physical characteristics of the player based on the at least one key player data element, linking, by the tracking controller, the player data object to a player identifier associated with the player, generating, by the tracking controller, a token identifier for the detected token set based on the at least one key token data element, and linking, by the tracking controller, the token identifier to the player data object based on a physical relationship between the player and the token set indicated by the at least one key player data element and the at least one key token data element.

According to yet another aspect of the disclosure, a tracking controller for a casino gaming environment is provided. The tracking controller includes a communication device communicatively coupled to an image sensor that captures image data of a gaming table and a player area associated with the gaming table, at least one processor, and a memory device communicatively coupled to the at least one processor. The memory device stores computer-executable instructions that, when executed by the at least processor, cause the tracking controller to detect a player occupying the player area and a token set from the captured image data at least by applying at least one image neural network model to the captured image data to generate at least one key player data element for the player and to generate at least one key token data element for the token set, generate a player data object representing physical characteristics of the player based on the at least one key player data element, link the player data object to a player identifier associated with the player, generate a token identifier for the detected token set based on the at least one key token data element, and link the token identifier to the player data object based on a physical relationship between the player and the token set indicated by the at least one key player data element and the at least one key token data element.

Additional aspects of the invention will be apparent to those of ordinary skill in the art in view of the detailed description of various embodiments, which is made with reference to the drawings, a brief description of which is provided below.

Figure 1:
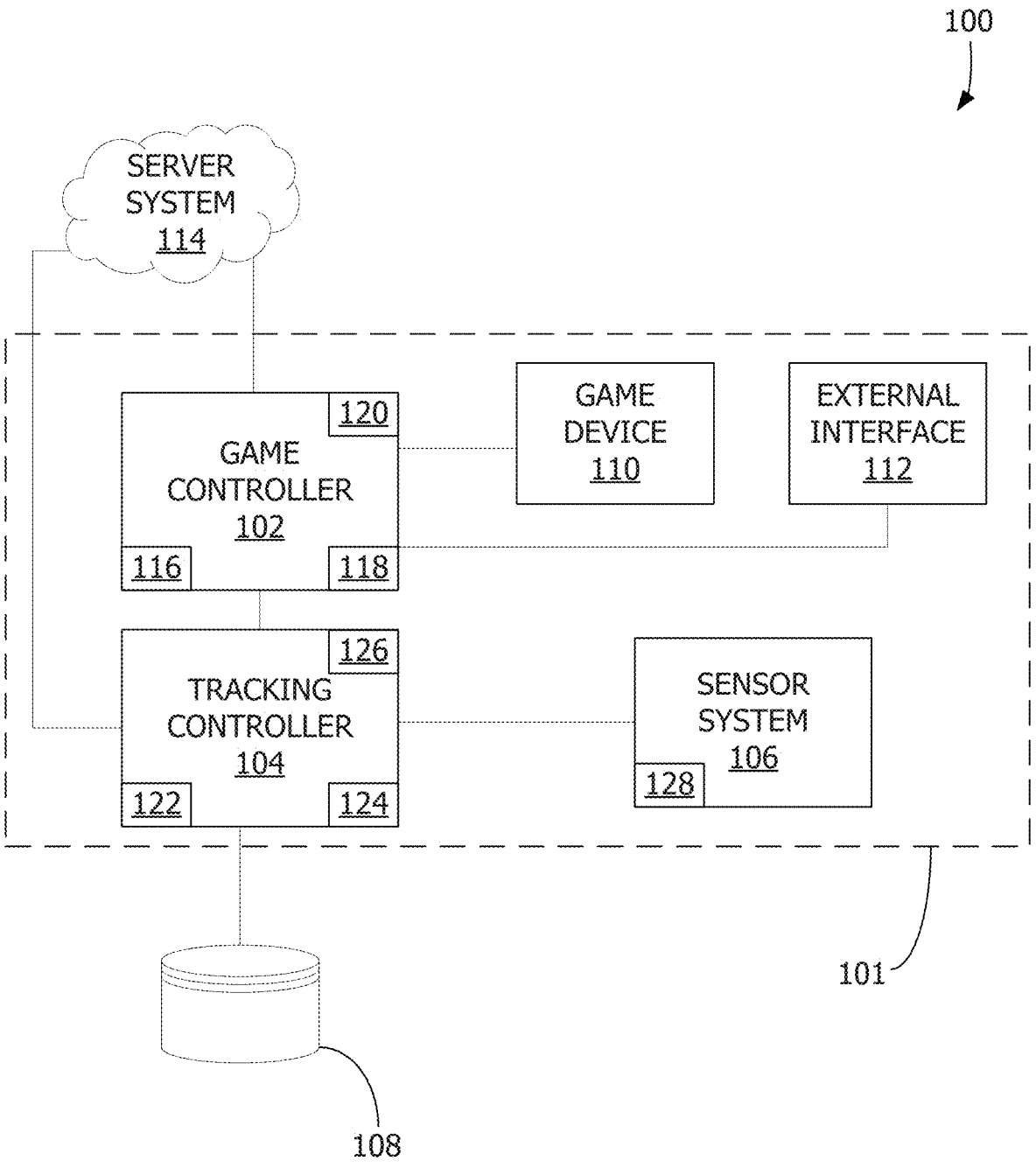
FIG. 1 is a block diagram of an exemplary gaming system according to one or more embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

As used herein, a "back wager" is a wager provided by a passive participant of a wagering game sometimes referred to herein as a "back player" or "passive player." Unlike an active participant that may perform actions beyond wagering (e.g., drawing cards), a passive player may not have any control in the game beyond what player, outcome, or other aspect on which the back wager is provided. In certain embodiments, the back players may have some form of active participation that is differentiated from the active participation of an active player. For example, a base game feature may only include participation by active players, while a bonus game feature of the wagering game may include the back players as active participants.

In some embodiments, back wagers may be placed on active players such that a winning outcome for the active player causes the associated back wagers to result in payouts. The payouts may be based on a payout table of the wagering game or a dedicated payout table for back wagers. In other embodiments, the back wagers may be placed irrespective of the active players, such as back wagers on the occurrence of a particular outcome or card sequence (e.g., royal flush). It is to be understood that several forms of back wagers (including the ones described above) may be present within a wagering game. The placement and resolution of the back wagers may occur before, after and/or concurrent to the placement and resolution of active wagers depending upon the rules and nature of the wagering game.

Systems and methods described herein facilitate tracking of players and game elements within a gaming environment.

In particular, the systems and methods described herein may (i) capture image data of a gaming table and an associated player area, (ii) analyze the captured image data at least using one or more imaging deep neural networks and/or other imaging analysis tools to translate the captured image data into key data elements representing aspects of players and gaming tokens detected in the image data, and (iii) by analyzing the key data elements and determining a physical relationship between the tokens and a player (e.g., tokens secured in the player's hand), linking the tokens to the player.

Linking tokens to a player may facilitate, for example, improved payout tracking, especially for games in which participation is not limited to players seated at the gaming table. That is, players may be able to participate in such games through back wagers. The number of back players and/or the positioning of the back players (i.e., the back players may move during play of the game) may cause confusion for the dealer when determining payouts. The systems and methods described herein may provide the dealer with an indication of the correct recipient of a particular payout. In at least some embodiments, the systems and methods described herein may facilitate improved security against counterfeit gaming tokens, which may be another risk in games with back wagers. If a counterfeit gaming token is detected, the systems and methods described herein may store a historical record of the token, which may be used to trace back to the original player of the counterfeit token.

Furthermore, the systems and methods described herein may enable improved player tracking for player accounts by reducing the burden on the player and/or dealer to indicate to a player tracking system the player's identity. That is, in at least some known player tracking systems, the player may be required to swipe a card associated with the player's account to "card-in" at the gaming table, and otherwise the player's participation may not be recorded to his or her player account. The card-in requirement may forgotten and/or inconvenient to some players (particularly to back players that may not have easy access to a card-in device at the gaming table), and thus eliminating or otherwise reducing this requirement may improve player tracking.

FIG. 1 is a block diagram of an example gaming system 100 for tracking aspects of a wagering game in a gaming area 101. In the example embodiment, the system 100 includes a game controller 102, a tracking controller 104, a sensor system 106, and a tracking database system 108. In other embodiments, the system 100 may include additional, fewer, or alternative components, including those described elsewhere herein.

Figure 2:
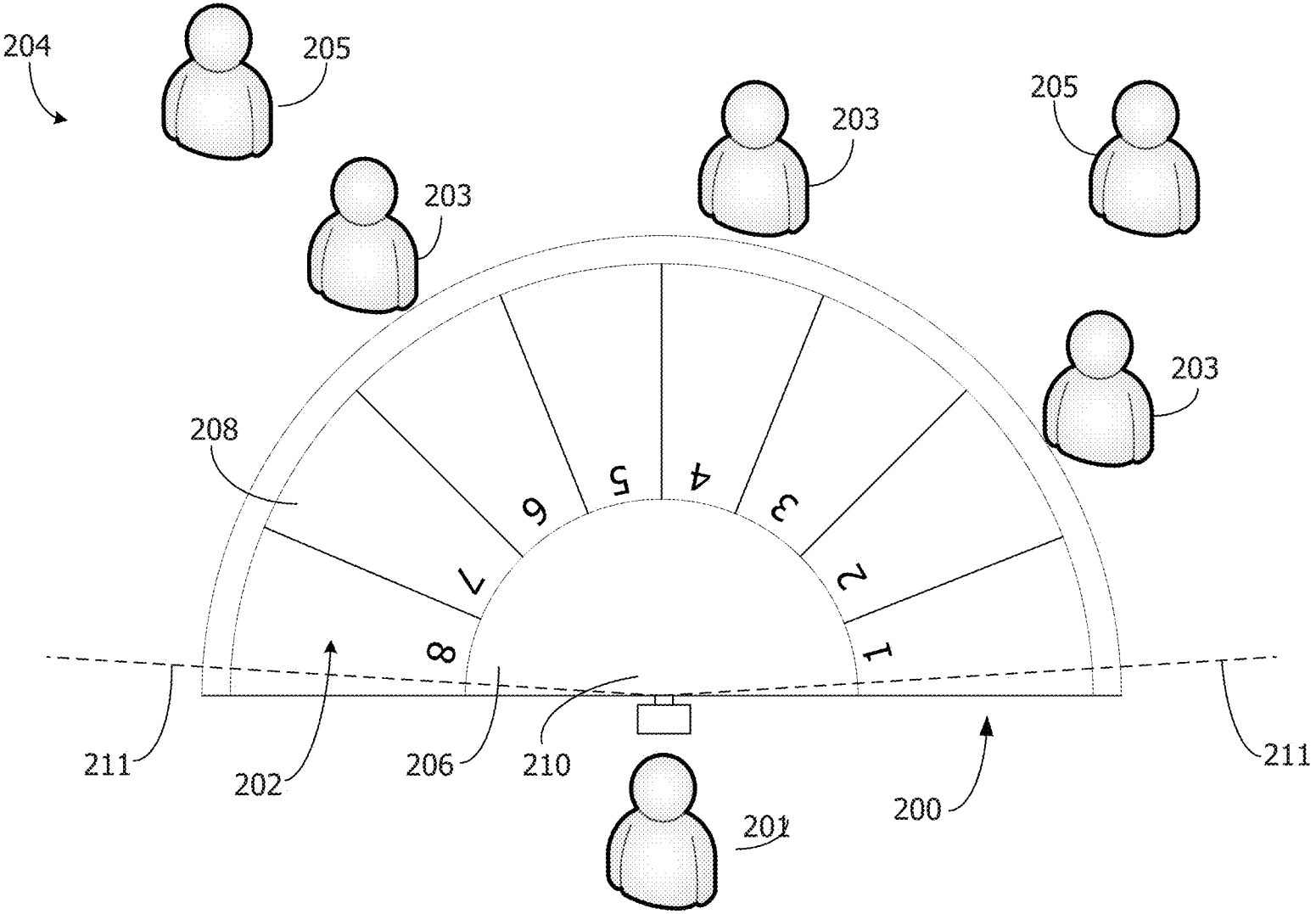
FIG. 2 is a top view of an exemplary gaming table and associated player area that may incorporate a player tracking system according to one or more embodiments of the present disclosure.

The gaming area 101 is an environment in which one or more casino wagering games are provided. In the example embodiment, the gaming area 101 is a casino gaming table and the area surrounding the table (an example of which is shown in FIG. 2). In other embodiments, other suitable gaming areas 101 may be monitored by the system 100. For example, the gaming area 101 may include one or more floor-standing electronic gaming machines. In another example, multiple gaming tables may be monitored by the system 100. Although the description herein references the gaming area 101 to be a single gaming table and the area surrounding the gaming table, it is to be understood that other gaming areas 101 may be used with the system 100 by employing the same, similar, and/or adapted details as described herein.

The game controller 102 is configured to facilitate, monitor, manage, and/or control gameplay of the one or more games at the gaming area 101. More specifically, the game controller 102 is communicatively coupled to at least one or more of the tracking controller 104, the sensor system 106, the tracking database system 108, a gaming device 110, an external interface 112, and/or a server system 114 to receive, generate, and transmit data relating to the games, the players, and/or the gaming area 101. The game controller 102 may include one or more processors 116, memory devices 118, and a communication device 120 to perform the functionality described herein. More specifically, the memory devices 118 store computer-readable instructions that, when executed by the processors 116, cause the game controller 102 to function as described herein, including communicating with the devices of the system 100 via the communication device 120.

The game controller 102 may be physically located at the gaming area 101 as shown in FIG. 1 or remotely located from the gaming area 101. In certain embodiments, the game controller 102 may be a distributed computing system. That is, several devices may operate together to provide the functionality of the game controller 102. In such embodiments, at least some of the devices (or their functionality) described in FIG. 1 may be incorporated within the distributed game controller 102.

The gaming device 110 is configured to facilitate one or more aspects of a game. For example, for card-based games, the gaming device 110 may be a card shuffler, shoe, or other card-handling device. The external interface 112 is a device that presents information to a player, dealer, or other user and may accept user input to be provided to the game controller 102. In some embodiments, the external interface 112 may be a remote computing device in communication with the game controller 102, such as a player's mobile device. The server system 114 is configured to provide one or more backend services and/or gameplay services to the game controller 102. For example, the server system 114 may include accounting services to monitor wagers, payouts, and jackpots for the gaming area 101. In another example, the server system 114 is configured to control gameplay by sending gameplay instructions or outcomes to the game controller 102. It is to be understood that the devices described above in communication with the game controller 102 are for exemplary purposes only, and that additional, fewer, or alternative devices may communicate with the game controller 102, including those described elsewhere herein.

In the example embodiment, the tracking controller 104 is in communication with the game controller 102. In other embodiments, the tracking controller 104 is integrated with the game controller 102 such that the game controller 102 provides the functionality of the tracking controller 104 as described herein. Like the game controller 102, the tracking controller 104 may be a single device or a distributed computing system. In one example, the tracking controller 104 may be at least partially located remotely from the gaming area 101. That is, the tracking controller 104 may receive data from one or more devices located at the gaming area 101 (e.g., the game controller 102 and/or the sensor system 106), analyze the received data, and/or transmit data back based on the analysis.

In the example embodiment, the tracking controller 104, similar to the example game controller 102, includes one or more processors 122, a memory device 124, and at least one communication device 126. The memory device 124 is configured to store computer-executable instructions that, when executed by the processor(s) 122, cause the tracking controller 104 to perform the functionality of the tracking controller 104 described herein. The communication device 126 is configured to communicate with external devices and systems using any suitable communication protocols to enable the tracking controller 104 to interact with the external devices and integrates the functionality of the controller 104 with the functionality of the external devices. The tracking controller 104 may include several communication devices 126 to facilitate communication with a variety of external devices using different communication protocols.

The tracking controller 104 is configured to monitor at least one or more aspects of the gaming area 101. In the example embodiment, the tracking controller 104 is configured to monitor at least the players within the gaming area 101, the gaming tokens within the area 101, and the relationship between each monitored player and each monitored stack of gaming tokens. The tokens may be any physical object (or set of physical objects) used to place wagers. As used herein, the term "stack" refers to one or more gaming tokens physically grouped together. For circular tokens typically found in casino gaming environments, these may be grouped together into a vertical stack. In another example in which the tokens are monetary bills and coins, a group of bills and coins may be considered a "stack" based on the physical contact of the group with each other and other factors as described herein.

In the example embodiment, the tracking controller 104 is communicatively coupled to the sensor system 106 to monitor the gaming area 101. More specifically, the sensor system 106 includes one or more sensors configured to collect sensor data associated with the gaming area 101, and the tracking system 104 receives and analyzes the collected sensor data to detect and monitor players and tokens. The sensor system 106 may include any suitable number, type, and/or configuration of sensors to provide sensor data to the game controller 102, the tracking controller 104, and/or another device that may benefit from the sensor data.

In the example embodiment, the sensor system 106 includes at least one image sensor 128 that is oriented to capture image data of players and tokens in the gaming area 101. In one example, the sensor system 106 may include a single image sensor 128 that monitors the gaming area 101. In another example, the sensor system 106 includes a plurality of image sensors 128 that monitor subdivisions of the gaming area 101. The image sensor 128 may be part of a camera unit of the sensor system 106 or a three-dimensional (3D) camera unit in which the image sensor 128, in combination with other image sensors 128 and/or other types of sensors, may collect depth data related to the image data, which may be used to distinguish between objects within the image data. The image data is transmitted to the tracking controller 104 for analysis as described herein. In some embodiments, the image sensor 128 is configured to transmit the image data with limited image processing or analysis such that the tracking controller 104 and/or another device receiving the image data performs the image processing and analysis. In other embodiments, the image sensor 128 may perform at least some preliminary image processing and/or analysis prior to transmitting the image data. In such embodiments, the image sensor 128 may be considered an extension of the tracking controller 104, and as such, functionality described herein related to image processing and analysis that is performed by the tracking controller 104 may be performed by the image sensor 128 (or a dedicated computing device of the image sensor 128). In certain embodiments, the sensor system 106 may include, in addition to or instead of the image sensor 128, one or more sensors configured to detect objects, such as time-of-flight sensors, radar sensors (e.g., LIDAR), and the like.

The tracking controller 104 is configured to establish data structures relating to each player and token stack detected in the image data from the image sensor 128. In particular, in the example embodiment, the tracking controller 104 applies one or more image neural network models during image analysis that are trained to detect aspects of players, tokens, and/or combinations thereof. Neural network models are analysis tools that classify "raw" or unclassified input data without requiring user input. That is, in the case of the raw image data captured by the image sensor 128, the neural network models may be used to translate patterns within the image data to data object representations of, for example, tokens, faces, hands, etc., thereby facilitating data storage and analysis of objects detected in the image data as described herein.

At a simplified level, neural network models are a set of node functions that have a respective weight applied to each function. The node functions and the respective weights are configured to receive some form of raw input data (e.g., image data), establish patterns within the raw input data, and generate outputs based on the established patterns. The weights are applied to the node functions to facilitate refinement of the model to recognize certain patterns (i.e., increased weight is given to node functions resulting in correct outputs), and/or to adapt to new patterns. For example, a neural network model may be configured to receive input data, detect patterns in the image data representing human faces, and generate an output that classifies one or more portions of the image data as representative of human faces (e.g., a box having coordinates relative to the image data that encapsulates a face and classifies the encapsulated area as a "face" or "human").

To train a neural network to identify the most relevant guesses for identifying a human face, for example, a predetermined dataset of raw image data including human faces and with known outputs is provided to the neural network. As each node function is applied to the raw input of a known output, an error correction analysis is performed such that node functions that result in outputs near or matching the known output may be given an increased weight while node functions having a significant error may be given a decreased weight. In the example of identifying a human face, node functions that consistently recognize image patterns of facial features (e.g., nose, eyes, mouth, etc.) may be given additional weight. The outputs of the node functions (including the respective weights) are then evaluated in combination to provide an output such as a data structure representing a human face. Training may be repeated to further refine the pattern-recognition of the model, and the model may still be refined during deployment (i.e., raw input without a known data output).

At least some of the neural network models applied by the tracking controller 104 may be deep neural network (DNN) models. DNN models include at least three layers of node functions linked together to break the complexity of image analysis into a series of steps of increasing abstraction from the original image data. For example, for a DNN model trained to detect human faces from an image, a first layer may be trained to identify groups of pixels that may represent the boundary of facial features, a second layer may be trained to identify the facial features as a whole based on the identified boundaries, and a third layer may be trained to determine whether or not the identified facial features form a face and distinguish the face from other faces. The multi-layered nature of the DNN models may facilitate more targeted weights, a reduced number of node functions, and/or pipeline processing of the image data (e.g., for a three-layered DNN model, each stage of the model may process three frames of image data in parallel).

In at least some embodiments, each model applied by the tracking controller 104 may be configured to identify a particular aspect of the image data and provide different outputs such that the tracking controller 104 may aggregate the outputs of the neural network models together to identify and link players and tokens as described herein. For example, one model may be trained to identify human faces, while another model may be trained to identify the bodies of players. In such an example, the tracking controller 104 may link together a face of a player to a body of the player by analyzing the outputs of the two models. In other embodiments, a single DNN model may be applied to perform the functionality of several models.

As described in further detail below, the tracking controller 104 may generate a player data object and/or a token data object for each player and token, respectively, identified within the captured image data by the DNN models. The player and token data objects are data structures that are generated to link together data associated with a corresponding player or token. For example, the outputs of several DNN models associated with a player may be linked together as part of the player data object.

It is to be understood that the underlying data storage of the player and token data objects may vary in accordance with the computing environment of the memory device or devices that store the data object. That is, factors such as programming language and file system may vary the where and/or how the data object is stored (e.g., via a single block allocation of data storage, via distributed storage with pointers linking the data together, etc.). In addition, some data objects may be stored across several different memory devices or databases.

In the example embodiment, the player data objects include a player identifier, and the token data objects include a token identifier. The player and token identifiers uniquely identify a player or stack of tokens, respectively, such that the data stored within the player and token data objects is tied to the player or stack of tokens. In at least some embodiments, the player identifier and/or the token identifier may be incorporated into other systems or subsystems. For example, a player account system may store player identifiers as part of player accounts, which may be used to provide benefits, rewards, and the like to players. In certain embodiments, the player identifier and/or the token identifier may be provided to the tracking controller 104 by other systems that may have already generated the identifiers.

In at least some embodiments, the player data objects, the player identifiers, the token data objects, and/or the token identifiers may be stored by the tracking database 108. The tracking database 108 includes one or more data storage devices that store data from at least the tracking controller 104 in a structured, addressable manner. That is, the tracking database 108 stores data according to one or more linked metadata fields that identify the type of data stored and can be used group stored data together across several metadata fields. The stored data is addressable such that stored data within the tracking database 108 may be tracked after initial storage for retrieval, deletion, and/or subsequent data manipulation (e.g., editing or moving the data). The tracking database 108 may be formatted according to one or more suitable file system structures (e.g., FAT, exFAT, ext4, NTFS, etc.).

The tracking database 108 may be a distributed system (i.e., the data storage devices are distributed to a plurality of computing devices) or a single device system. In certain embodiments, the tracking database 108 may be integrated with one or more computing devices configured to provide other functionality to the system 100 and/or other gaming systems. For example, the tracking database 108 may be integrated with the tracking controller 104 or the server system 114.

In the example embodiment, the tracking database 108 is configured to facilitate a lookup function on the stored data for the tracking controller. The lookup function compares input data provided by the tracking controller 104 to the data stored within the tracking database 108 to identify any "matching" data. It is to be understood that "matching" within the context of the lookup function may refer to the input data being the same, substantially similar, or linked to stored data in the tracking database 108. For example, if the input data is an image of a player's face, the lookup function may be performed to compare the input data to a set of stored images of historical players to determine whether or not the player captured in the input data is a returning player. In this example, one or more image comparison techniques may be used to identify any "matching" image stored by the tracking database 108. For example, key visual markers for distinguishing the player may be extracted from the input data and compared to similar key visual markers of the stored data. If the same or substantially similar visual markers are found within the tracking database 108, the matching stored image may be retrieved. In addition to or instead of the matching image, other data linked to the matching stored image may be retrieved during the lookup function, such as a player account number, the player's name, etc. In at least some embodiments, the tracking database 108 includes at least one computing device that is configured to perform the lookup function. In other embodiments, the lookup function is performed by a device in communication with the tracking database 108 (e.g., the tracking controller 104) or a device in which the tracking database 108 is integrated within.

FIG. 2 is a top view of an example gaming table 200 that may be used with the system 100 shown in FIG. 1. The gaming table 200 includes a playing surface 202 and has an associated player area 204. In other embodiments, other suitable gaming areas may be used with the system 100, including, but not limited to, other gaming tables, electronic gaming machines, and the like.

The playing surface 202 includes markings or indicia to define functionality for particular portions of the playing surface 202. For example, the playing surface 202 includes a dealer area 206 and a plurality of player bet areas 208. In other embodiments, the playing surface 202 may include other suitable markings or indicia, which may be at least partially dictated by the type of game, the number of possible players, the game features, and other factors associated with the gaming table 200.

In the example embodiment, the dealer area 206 is an area that is managed by a dealer 201. For example, gaming devices (e.g., a card-handling device) may occupy the dealer area 206 for the dealer 201 to operate. In another example, community cards may be dealt within the dealer area 206. In the example embodiment, the dealer area 206 includes a wide-angle camera 210 of an sensor system (e.g., the sensor system 106, shown in FIG. 1) configured to capture images and/or video of the gaming table 200 and the player area 204 for tracking players and token as described herein. The camera 210 is positioned to capture images or video of an area (indicated by dotted lines 211) that includes at least each player position of the table 200. In other embodiments, the camera 210 may be in a different position relative to the table 200 and the player area 204. For example, the camera 210 may be positioned away from the table 200 behind or above the dealer 201. In certain embodiments, a plurality of cameras 210 may be used to capture different perspectives and/or portions of the table 200 and the player area 204. In one example, a second camera is positioned above the player area 204 in combination with the camera 210 to provide three-dimensional image data of the player area 204.

Each player bet area 208 is associated with a player position (indicated in FIG. 2 by the number within each player bet area 208) at the gaming table 200 that are occupied by active players 203 to play a game at the gaming table 200. The player bet area 208 provide a visual separation between wagers, playing cards, and the like between active players 203. In addition, the player bet areas 208 provide a visual indication of the maximum number of active players 203 that can participate in a game at the gaming table at a given time.

In at least some embodiments, the game conducted at the gaming table 200 may include back wagers to enable back players 205 to passively participate in the game. In the example embodiment, the back wager is linked to the outcome of one of the active players 203—if the associated active player 203 achieves a winning outcome in the game, a payout is provided to the back player 205 for the back wager. To place the back wager, the back player 205 places one or more tokens within the player bet area 208 of one of the active players 203. With respect to the example playing surface 202, back wagers intermingle with wagers placed by the active players 203 within the player bet area 206. In some embodiments, the number of wagers associated with a particular active player 203 may be limited to reduce the complexity of payout determination as described herein. In other embodiments, the player bet areas 206 may include additional indicia to distinguish between active wagers placed by the active players 203 and back wagers placed by the back players 205.

In the example embodiment, the wagers are placed for a given round or hand of the game prior to an outcome of the round. After the outcome is determined, any winning outcomes are identified, and payouts may be provided for any wagers associated with the winning outcomes. More specifically, if a winning outcome for one of the active players 203 is identified, the active wager of the winning active player 203 and any back wagers associated with the winning active player 203 result in payouts while wagers associated with non-winning outcomes may not receive payouts. The payouts may be fixed (i.e., the outcome has a predetermined payout amount) or at least partially a function of the wager amount and payout multiplier or ratio associated with the winning outcome specified by one or more payout tables. For example, a winning outcome may be associated with a 2× payout multiplier, and the payout is two times the wager amount. In some embodiments, active players 203 and back players 205 may have different fixed payouts or pay tables for a particular winning outcome. In other embodiments, the same fixed payouts or pay tables may apply to both active players 203 and back players 205.

To resolve the payouts, the dealer 201, with or without assistance from one or more devices monitoring the gaming table 200 (e.g., the game controller 102, shown in FIG. 1), identifies any winning outcomes and the payout amount for each wager associated with the identified winning outcomes. The token stacks representing each payout are then distributed to the corresponding players before a subsequent round begins.

In existing systems, back wagers may increase the complexity of payout attribution. That is, unlike active players 203 that remain in a fixed position and are distinguishable through the indicia of the playing surface (e.g., the player positions are distinguishable by the numbers within the player bet areas 208), back players 205 are largely untethered to the gaming table 200. The back players 205 may move during play of the game, or the player area 204 may be occupied by a relatively large number of back players 205 and/or non-participating observers. If the dealer 201 does not remember the face of each back player 205 associated with each and every back wager, the dealer 201 may have difficultly attributing payouts to the correct back player 205. This may result in bad faith players collecting payouts in place of other back players 205, and/or indirect awards (e.g., awards from player tracking systems for participation in the game) may be incorrectly attributed to the wrong player.

Moreover, some playing surfaces (including the playing surface 202) may not distinguish between the active wagers and the back wagers associated with a particular player bet area 208, which may result in problems similar to those described above between back players 205 when using existing player tracking systems. For example, for player tracking systems that identify players through a "card-in" process (e.g., the player swipes a player card at the gaming table 200 to check-in), the lack of distinguishable indicia between back wagers and active wagers may result in the active player 203 unfairly collected player tracking awards for both his or her active wager and any associated back wagers. These issues posed by at least some existing tracking systems are at least partially a result of the tracking being tethered to the playing surface 202, either through the tracking being performed via sensors integrated within the table 200 or the tracking systems being reliant upon each player position being associated with a single player.

Accordingly, the systems and methods described herein facilitate tracking of players, tokens, and the relationship between players and tokens irrespective of the playing surface 202. More specifically, a video stream of image data is captured by the camera 210 and is sent to the tracking controller 104 (shown in FIG. 1) for image processing and analysis to identify each player and token stack present at the gaming table 200 and the player area 204. Player identification may be used to supplement or otherwise replace manual player check-in for player accounts as well as provide improved anonymous player accounts as described herein. The identified players and token stacks may also be linked to each other to track which player has placed a wager using a token stack, thereby improving payout attribution.

Figure 3:
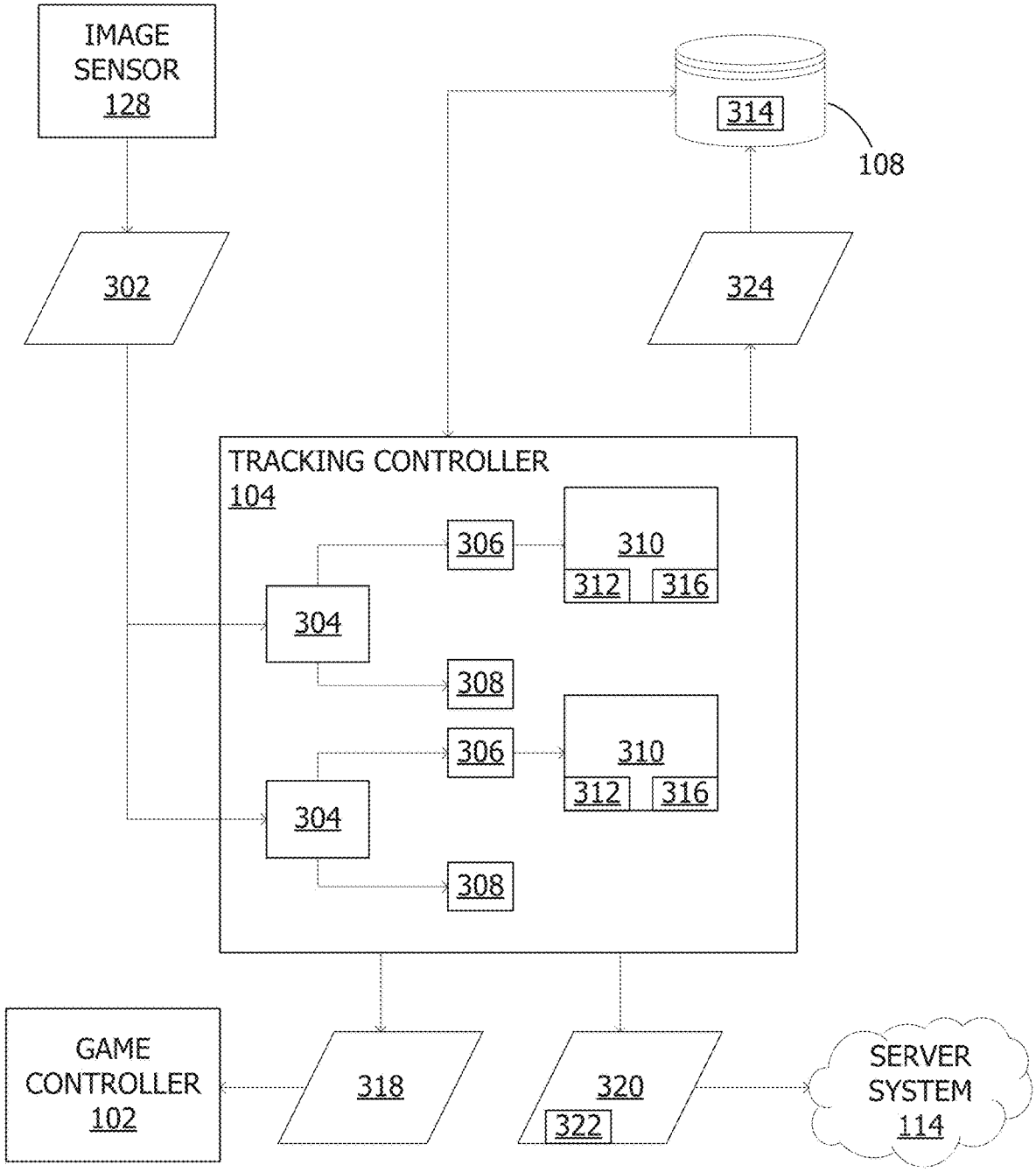
FIG. 3 is a data flow block diagram of the gaming system shown in FIG. 1 for tracking players and tokens according to one or more embodiments of the present disclosure.
Figure 4:
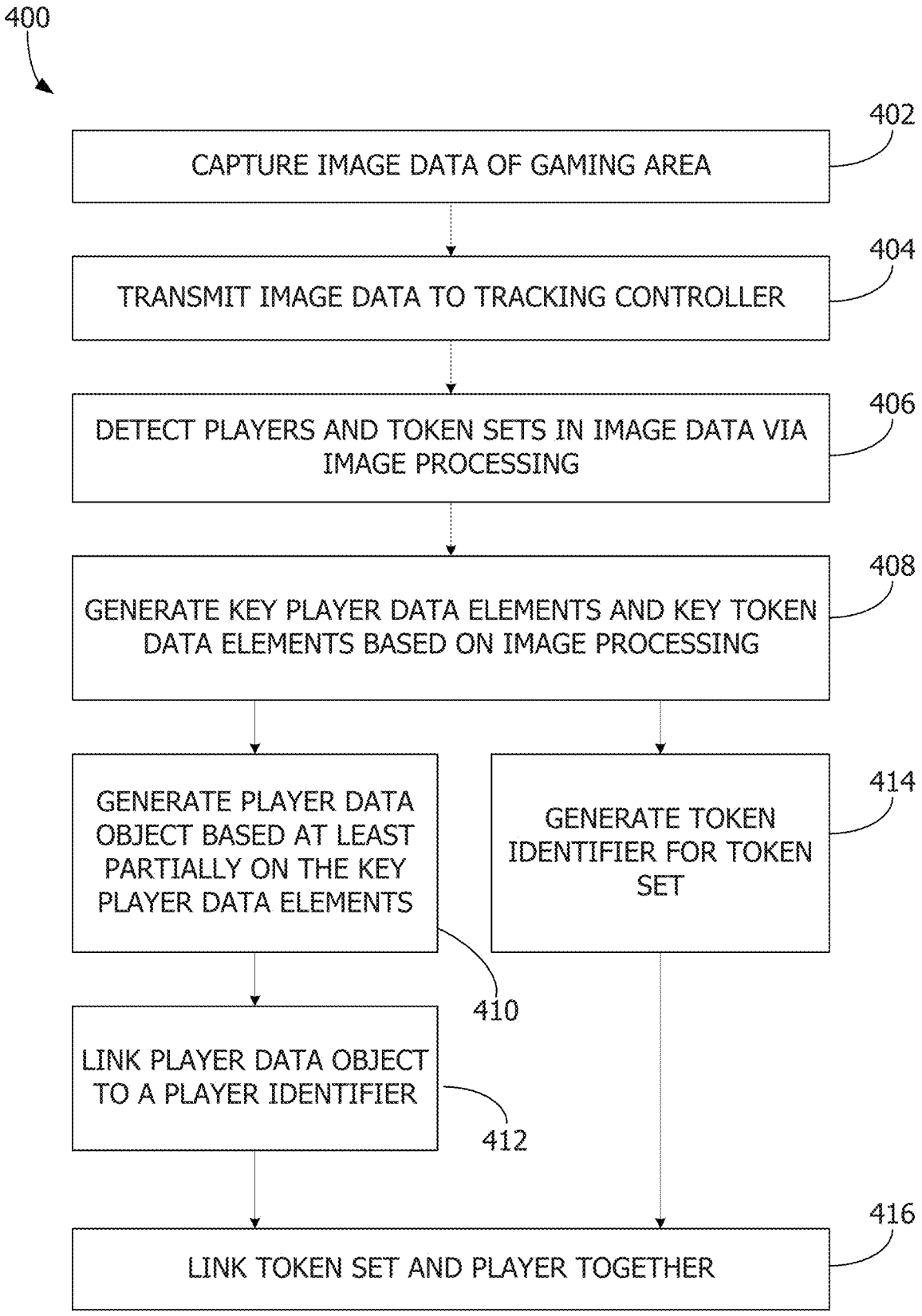
FIG. 4 is a flow diagram of an exemplary tracking method associated with the data flow shown in FIG. 3 according to one or more embodiments of the present disclosure.

FIG. 3 is a data flow diagram of an example player tracking method 400 using the system 100 (shown in FIG. 1). FIG. 4 illustrates a flow diagram of the method 400. In the example embodiment, the method 400 is implemented for an example table-based game that supports back wagers similar to the back wagers described in FIG. 2. In other embodiments, the method 400 may include additional, fewer, or alternative data elements and/or steps, including those described elsewhere herein.

In the example embodiment, the image sensor 128 is configured to capture 402 a video stream of image data 302 of the gaming area 101 (shown in FIG. 1). For exemplary purposes, the gaming area 101 is referred to herein with respect to FIGS. 3 and 4 as a gaming table and its associated player area (e.g., table 200 and player area 204, shown in FIG. 2), though it is to be understood that the data elements and/or steps described with respect FIGS. 3 and 4 may apply to other gaming areas 101.

The image data 302 may be continuously captured at a predetermined framerate or periodically. The image data 302, for the purposes of this disclosure, is considered "raw" image data in the sense that no object detection and classification is performed by the image sensor 128, though other metadata (e.g., timestamps) and image processing may be included with the image data 302. The image data 302 is transmitted 404 to the tracking controller 104 for image processing and analysis.

In at least some embodiments, the tracking controller 104 stores the received image data 302 in a video buffer (e.g., within a memory device, such as the memory device 124, shown in FIG. 1) such that each frame of the image data 302 (or a subset of key frames) is stored for subsequent image processing. The tracking controller 104 is configured to process the image data 302 to detect 406 any players and stacks of the tokens (referred to herein as "token sets"). More specifically, one or more image neural network models 304 are applied to the raw image data 302 to extract data representative of the players and token sets. The neural network models 304 may be implemented via software modules executed by the tracking controller 104 and/or implemented via hardware of the tracking controller dedicated to at least some functionality of the neural network models 304.

In the example embodiment, several neural network models 304 are implemented together by the tracking controller 104 to extract different features from the image data 302. That is, the neural network models 304 may be trained to identify particular characteristics of tokens and players. For example, one neural network model 304 may be trained to identify human faces, while another neural network model 304 may be trained to identify human torsos. Specific examples of such image neural network models 304 are described in further detail below with respect to FIGS. 5-9 and 13-15.

Although the output of the image neural network models 304 may vary depending upon the specific functionality of each model 304, the outputs generally include one or more data elements that represent a physical feature or characteristic of a person or object in the image data 302 in a format that can be recognized and processed by tracking controller 104 and/or other computing devices. For example, one example neural network model 304 may be used to detect the faces of players in the image data 302 and output a map of data elements representing "key" physical features of the detected faces, such as the corners of mouths, eyes, nose, ears, etc. The map may indicate a relative position of each facial feature within the space defined by the image data 302 (in the case of a singular, two-dimensional image, the space may be a corresponding two-dimensional plane) and cluster several facial features together to distinguish between detected faces. The output map is a data abstraction of the underlying raw image data that has a known structure and format, which may be advantageous for use in other devices and/or software modules.

In the example embodiment, applying the image neural network models 304 to the image data 302 causes the tracking controller 104 to generate 408 one or more key player data elements 306 and/or key token data elements 308. The key player data elements 306 and the key token data elements 308 are the outputs of the image processing (including the models 304). Other suitable image processing techniques and tools may be implemented by the tracking controller 104 in place of or in combination with the neural network models 304. As described above, the key data elements 306, 308 represent one or more physical characteristics of the players (e.g., a face, a head, a limb, an extremity, or a torso) and tokens detected in the image data 302. The key data elements 306, 308 may include any suitable amount and/or type of data based at least partially on the corresponding neural network model 304. At least some of the key data elements 306, 308 include position data indicating a relative position of the represented physical characteristics within a space at least partially defined by the scope of the image data 302.

Key data elements 306, 308 may include, but are not limited to, boundary boxes, key feature points, vectors, wireframes, outlines, pose models, and the like. Boundary boxes are visual boundaries that encapsulate an object in the image and classify the encapsulated object according to a plurality of predefined classes (e.g., classes may include "human", "tokens", etc.). A boundary box may be associated with a single class or several classes (e.g., a player may be classified as both a "human" and a "male"). The key feature points, similar to the boundary boxes, classify features of objects in the image data 302, but instead assign a singular position to the classified features. In certain embodiments, the tracking controller 104 may include neural network models 304 trained to detect objects other than the players and the tokens.

Although the key data elements 306, 308 are described above as outputs of the neural network models 304, at least some key data elements 306, 308 may be generated using other object detection and/or classification techniques and tools. For example, a 3D camera of the sensor system 106 (shown in FIG. 1) may generate a depth map that provides depth information related to the image data such that objects may be distinguished from each other and/or classified based on depth, and at least some key data elements 306, 308 may be generated from the depth map. In another example, a LIDAR sensor of the sensor system 106 may be configured to detect objects to generate kay data elements 306, 308. In certain embodiments, the neural network models 304 may be used with other object detection tools and systems to facilitate classifying the detected objects.

Figure 12:
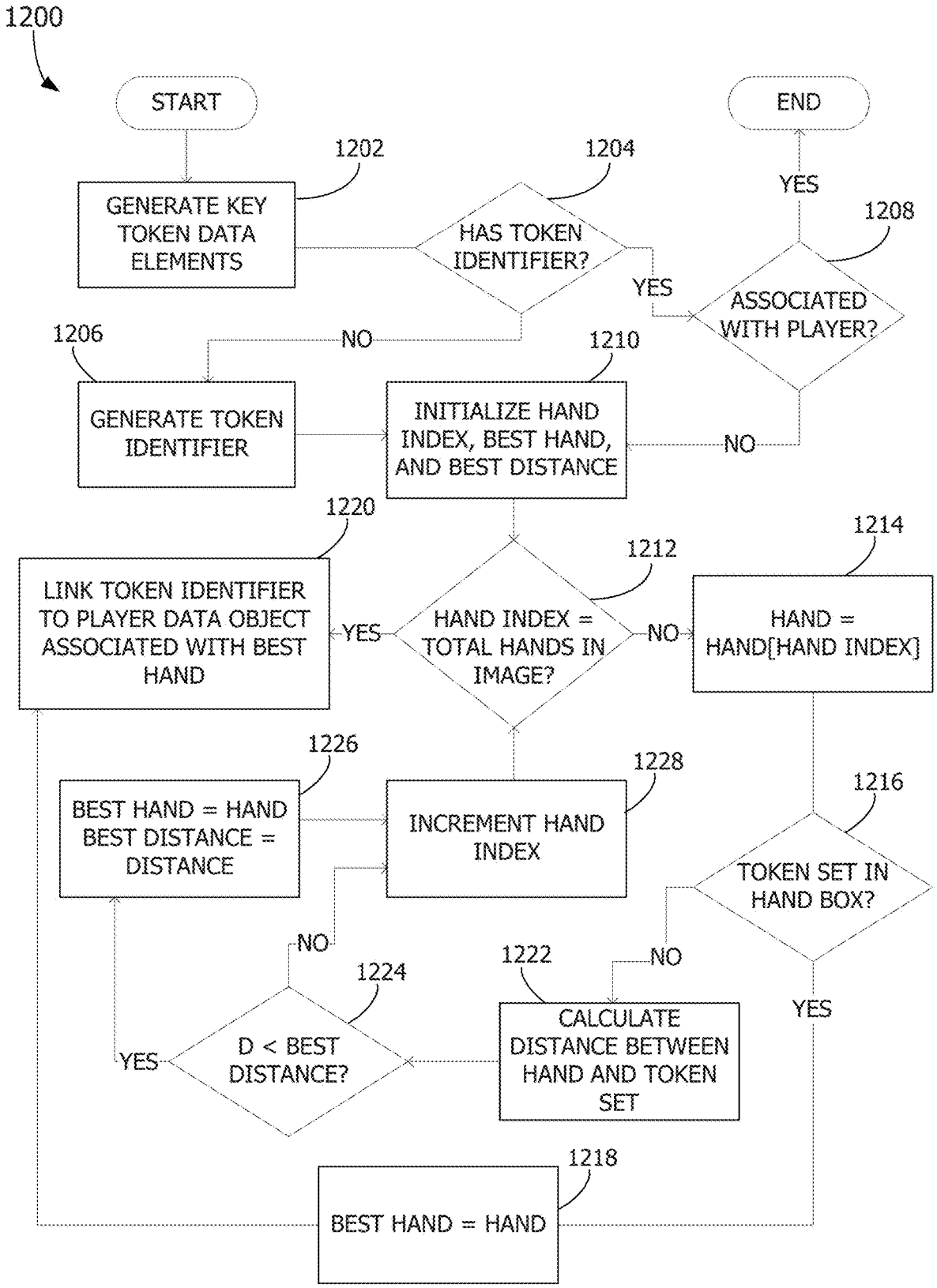
FIG. 12 is a flow diagram of an example method for linking a token set to a player that owns the tokens set based on image analysis.

After the key player data elements 306 and the key token data elements 308 are generated 408, the tracking controller 104 is configured to organize the key player data elements 306 and/or the key token data elements 308 to identify each respective player and token set. That is, the tracking controller 104 may be configured to assign the outputs of the neural network models 304 to a particular player or token set based at least partially on a physical proximity of the physical characteristics represented by the key player and token data elements 306, 308. FIG. 12 describes the process of linking together the key player and token data elements 306, 308 in further detail below.

In the example embodiment, the tracking controller 104 is configured to generate 410 a player data object 310 associated with a player based at least partially on the key player data elements 306. The player data object 310 is a structured allocation of data storage (i.e., a plurality of predefined data elements and corresponding metadata) that is attributed to a single player such that the tracking controller 104 may store data associated with the player from various sources (e.g., the different neural network models 304) together as the player data object 310. In some embodiments, the key player data elements 306 are stored within the player data object 310. In other embodiments, the tracking controller 104 may generate data based on the key player data elements 306 to be stored within the player data object 310, such as an aggregate pose model representing a combination of the key player data elements 306. In the example embodiment, the player data object 310 is linked 412 to a player identifier 312 uniquely associated with the player. The player identifier 312 may be generated by the tracking controller 104 or may be retrieved from another system or device that stores player identifiers.

For example, the player identifier 312 may be stored by a player account system as part of a player account associated with the player. In such an example, to retrieve the player identifier 312, the tracking controller 104 may transmit a request to the player tracking system including biometric data, such as an image of the player's face and/or key player data elements 306, which can be used to identify the player. The player tracking system may transmit the player identifier 312 back to the tracking controller 104 if a match is found. If no matching player account is found, the tracking controller 104 may generate the player identifier 312.

In another example, historical player data objects may be stored in a database, such as the tracking database system 108. In the example embodiment, the tracking database 108 stores historical player data 314 that is generated and/or collected by the tracking controller. The historical player data 314 may include, but is not limited to, historical key data elements, historical player data objects, and/or historical player identifiers. The tracking controller 104 may be configured to compare data from the player data object 310 to the historical player data objects stored in the tracking database system 108 to determine whether or not the player data object 310 (and the associated player) matches a previously generated player data object. If a match is found, the player identifier 312 and/or other suitable historical data may be retrieved from the tracking database system 108 to be included with the player data object 310. If no match is found, the player identifier 312 may be generated by the tracking controller 104 to be included with the player data object 310. In other embodiments, the player data object 310 may not be generated 410 prior to a comparison with the historical player data stored by the tracking database system 108. That is, the key player data elements 306 may be compared to the stored player data within the tracking database system 108 to determine whether or not a player data object 310 associated with the player has been previously generated 410. If a matching player data object 310 is found, the matching player data object 310 may be retrieved and updated with the key player data elements 306. If no match is found, the player data object 310 is then generated 410.

In some embodiments, the system 100 may facilitate anonymized player tracking through image tracking, thereby enabling players that do not wish to provide their name or other personal identifiable information to potentially gain at least some benefits of a player account while improving the management of the game environment via enhanced gameplay tracking. That is, if a player does not have a player account, the player may still be tracked using biometric data extracted from the image data 302 and may receive benefits for tracked gameplay, such as an award for historical performance and/or participation of the player. The biometric data is data that, through one or more detected physical features of the player, distinguishes the player from others. The biometric data may include, but is not limited to, the key player data elements 306 and/or data derived from the key player data elements 306.

In embodiments with anonymized player tracking, the tracking controller 104 may determine that no existing player account is associated with the player, and then generates 412 the player identifier 312 or retrieves the player identifier 312 from historical player data within the tracking database system 108. The anonymized player identifier 312 may be temporarily associated with the player until a predetermined period of time or a predetermined period of inactivity (i.e., the player is not detected or has not participated in a game over a period of time) has expired. Upon expiration, the player data object 310 and/or the player identifier 312 may be deleted from storage, and the player identifier 312 is reintroduced into a pool of available player identifiers to be assigned to other players.

In the example embodiment, the tracking controller 104 is configured to generate 414 a token identifier 316 for the token stack based on the key token data elements 308. Like the player identifier 312, the token identifier 316 uniquely identifies the token stack. The token identifier 316 may be used to link the token stack to a player as described in detail below. The tracking controller 104 may generate other data based on the key token data elements 308 and/or other suitable data elements from external systems (e.g., the sensor system 106, shown in FIG. 1). The token identifier 316 may be assigned to a token stack on a temporary basis. That is, the token stack may change over time (e.g., the addition or removal of tokens, splitting the stack into smaller sets, etc.), and as a result, the features indicated by the key token data elements 308 to distinguish the token stack may not remain fixed. Unlike the anonymized player identifiers 312, which may expire after a relatively extended period of time (e.g., two weeks to a month), the token identifiers 316 may "expire" over a relatively shorter period of time, such as a day, to ensure a pool of token identifiers 316 are available for newly detected token stacks or sets. In certain embodiments, the token identifiers 316 may be reset in response to a game event of the game conducted at the gaming table. For example, the conclusion of a game round and/or a payout process may cause at least one or more token identifiers to be reset.

In the example embodiment, the tracking controller 104 is configured to link 416 the token set and player together in response to determining the player is the owner or originator of the token set. More specifically, the tracking controller 104 detects a physical proximity between physical characteristics represented by the key player data elements 306 and the key token data elements 308, and then links the token identifier 316 to the player data object 310. The physical proximity may indicate, for example, that the player is holding the token set within his or her hand. In one example, the physical proximity is determined by comparing positional data of the key token data elements 308 to positional data of one or more player data objects 310 associated with players present in the image data 302.

In the example embodiment, the linking 416 is performed by storing the token identifier 316 with or within the player data object 310. The player data object 310 may be configured to store one or more token identifiers 316 at a given time to enable multiple token sets to be associated with the player. However, in some embodiments, each token identifier 316 may be linked to a single player data object 310 at a given time to prevent the token set from being erroneously attributed to an intermediate player. As used herein, an "intermediate player" is a player that may handle or possess the token set between the player and a bet area. For example, a back player may pass his or her tokens to an active player to reach a bet area on the gaming table. In this example, the active player has not gained possession of the tokens, but is merely acting as an intermediate to assist the back player in placing a wager. Even though the tracking controller 104 may detect a physical relationship or proximity between the token set and the intermediate player, the previous link by the original player and the token set may prevent the tracking controller from attributing the token set to the intermediate player.

Linking 416 the token set to a particular player may have several advantages. For example, a payout process may be improved by providing a dealer with improved information regarding (i) who placed which wager and (ii) at least some identifiable information for locating the winning players for the payout. That is, the game controller 102 and/or the tracking controller 104 may monitor play of the game at the game table, determine an outcome of the game, and determine which (if any) wagers are associated with a winning outcome resulting in a payout. The tracking controller 104 may transmit a payout message 318 to the game controller 102 and/or a dealer interface (not shown) to visually indicate to the dealer the one or more players associated with the winning outcome wagers. The payout message 318 may include an indication of the winning players such as, but not limited to, an image of the player's face, the player's name, a nickname, and the like. In certain embodiments, the tracking controller 104 may include a display, a speaker, and/or other audiovisual devices to present the information from the payout message 318.

In at least some embodiments, the tracking controller 104 is configured to generate one or more tracking messages 320 to be transmitted to one or more external devices or systems. More specifically, the functionality of other systems in communication with the tracking controller 104 may be enhanced and/or dependent upon data from the tracking controller 104. In the example embodiment, the tracking message 320 is transmitted to the server system 114. The tracking messages 320 are data structures having a predetermined format such that the tracking controller 104 and a recipient of the tracking message 320 can distinguish between data elements of the tracking message 320. The contents of the tracking messages 320 may be tailored to the intended recipient of the tracking message, and tracking messages 320 transmitted to different recipients may differ in the structure and/or content of the tracking messages 320.

In one example, a player account system in communication with the tracking controller 104 may receive the tracking message 320 to identify any players with player accounts present within the gaming environment monitored by the tracking controller 104. In such an example, the tracking message 320 may include location data 322 indicating a location of the player. The location data 322 may indicate the area monitored by the tracking controller 104, or the location data 322 may include further details of the player's location, such as an approximate location of the player within the area monitored by the tracking controller 104 based at least partially on the positions of the key player data elements 306 of the player. In another example, the tracking message 320 may be transmitted to the game controller 102 and/or an accounting system for monitoring wagers, payouts, and the players associated with each wager and payout.

In at least some embodiments, the tracking controller 104 is configured to generate annotated image data 324. The annotated image data 324 may be the image data 302 with at least the addition of graphical and/or metadata representations of the data generated by the tracking controller 104. For example, if the tracking controller 104 generates a bounding box encapsulating a token set, a graphical representation of the boundary box may be applied to the image data 302 to represent the generated boundary box. The annotated image data 324 may be an image filter that is selectively applied to the image data 302 or an altogether new data file that aggregates the image data 302 with data from the tracking controller 104. The annotated image data 324 may be stored as individual images and/or as video files. The annotated image data 324 may be stored in the tracking database system 108 as part of the historical player data 314.

In one example, the annotated image data 324 may be used to track counterfeit tokens back to its origin. At least some counterfeit tokens may be introduced and may go undetected until a token counting process is performed (e.g., at the end of the day). With known systems, it may be difficult to locate and identify the player that introduced the counterfeit tokens. When the counterfeit tokens are detected, the annotated image data 324 may be retrieved to identify the counterfeit tokens in the annotated image data 324 and track the counterfeit tokens back to the player that introduced them.

In the example embodiment, the player data object 310 and the token identifier 316 may be stored in the tracking database system 108 as subsequent image data 302 is retrieved from a video buffer of the tracking controller 104 and/or the image sensor 128 to process. Key player data elements and key token data elements from the subsequent image data 302 may be compared to the player data object 310 and the token identifier 316 to determine whether or not the player or token set have previously been identified. In some embodiments, the player data object 310 may updated with new key player data elements from the subsequent image data 302. In certain embodiments, the data from the player data object 310 may be retrieved instead of generating at least some key player data elements and/or other data related to the player, such as the player identifier 312.

The following figures illustrate several examples of the image processing performed by the tracking controller 104 at a gaming table. That is, the following figures illustrate several example images captured by an image sensor (e.g., the image sensor 128, shown in FIG. 1) at a gaming table and exemplary graphical representations of the key data elements generated from applying one or more neural networks to the image data. In at least some embodiments, the graphical representations may be part of the annotated image data generated by the tracking controller 104.

Figure 5:
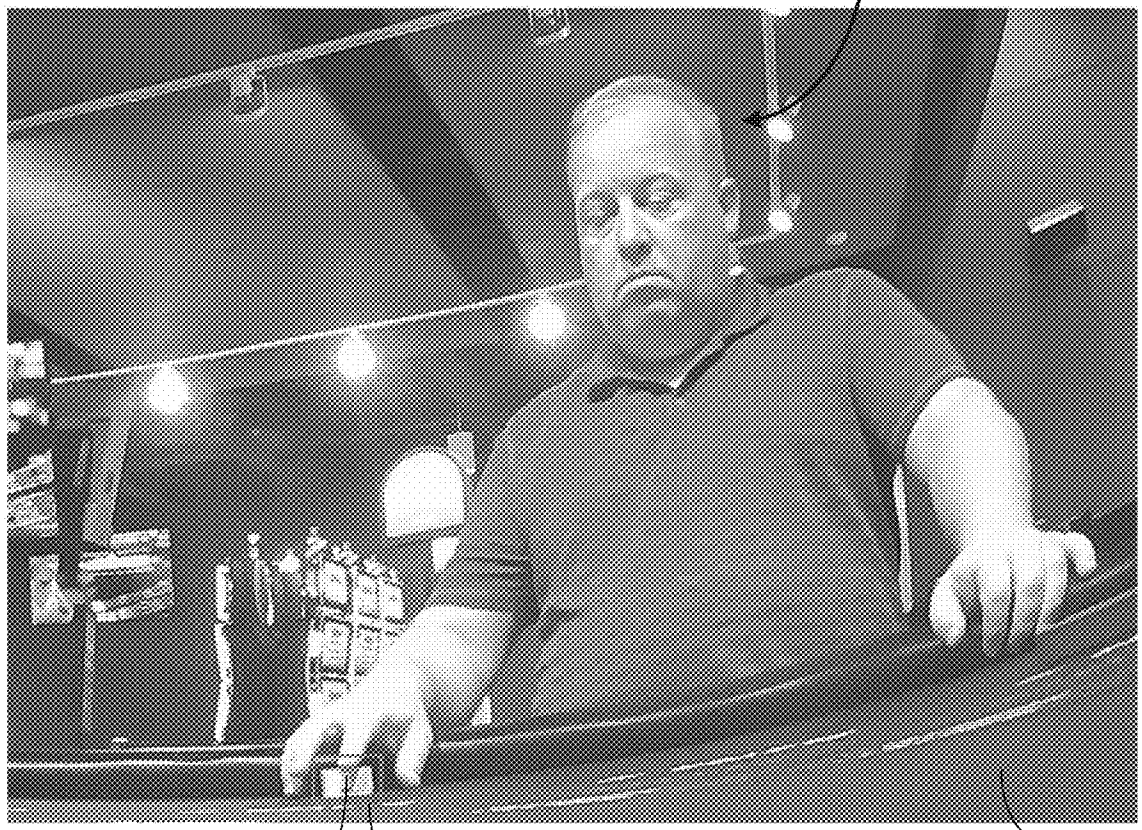
FIG. 5 is an example image frame of a gaming table and player area illustrating token detection.
Figure 6:
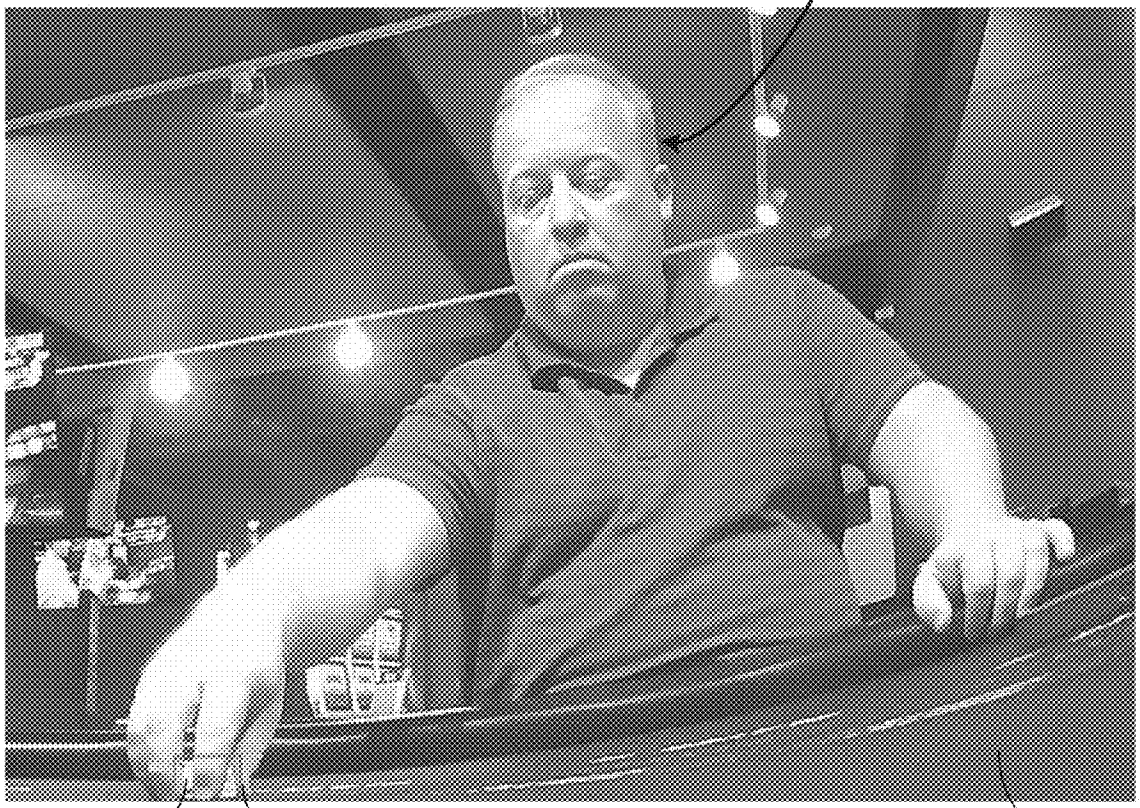
FIG. 6 is an image frame captured after the image frame of FIG. 5.

FIGS. 5 and 6 illustrate a player 502 at a gaming table 504 during play of a game. More specifically, FIGS. 5 and 6 depict example captured frames 500 and 600 of the player 502 positioned at a player position of the gaming table 504 by an image sensor (not shown in FIGS. 5 and 6). The frames 500, 600 are captured over time such that frame 500 illustrates the player 502 in a neutral position while the frame 600 illustrates the player 502 placing a wager.

In the example embodiment, the player 502 possesses a token set 506 for placing wagers. In other examples, the player 502 may possess a plurality of token sets 506 and/or token sets 506 having a different number of tokens. In the frame 500, the player 502 maintains the token set 506 near himself on the gaming table 504, whereas, in the frame 600, the player 502 has moved the token set 506 on the gaming table 504 to a betting or wagering area to wager the token set 506. If the frame 500 is assumed to be the precursor to the frame 600 in this example, intermediate frames may depict the player 502 physically engaging (e.g., picking up, pushing, etc.) the token set 506 to move the token set 506 within the betting area marked on the gaming table 504. Subsequent frames after the frame 600 may depict the player 502 releasing the token set 506 from his hand and moving his hand away from the token set 506 to participate in the game.

In the example embodiment, the frames 500, 600 include graphical representations of key data elements associated with the token set 506. More specifically, the tracking controller 104 has (i) analyzed the frames 500, 600 by applying one or more neural network models trained to identify token sets and (ii) generated a boundary box 508 that encapsulates the token set 506 within the frames 500, 600. The boundary box 508 may be a visual or graphical representation of one or more underlying key token data elements. For example, and without limitation, the key token data elements may specify coordinates within the frames 500, 600 for each corner of the boundary box 508, a center coordinate of the boundary box 508, and/or vector coordinates of the sides of the boundary box 508. Other key token data elements may be associated with the boundary box 508 that are not used to specify the coordinates of the box 508 within the frames 500, 600, such as, but not limited to, classification data (i.e., classifying the object in the frames 500, 600 as a "token set") and/or value data (e.g., identifying a value of the token set 506).

The position of the boundary box 508 is updated for each frame analyzed by the tracking controller 104 such that a particular token set 506 can be tracked over time. The key token data elements may be used to distinguish between two token sets detected within a frame. For example, if one token set contains three red tokens while a second token set contains five green tokens, the key token data elements for the two token sets may include distinguishable data indicating the color and/or size of the respective token sets. In at least some embodiments, the tracking controller 104 compares key token data elements generated for a particular frame to key token data elements of previously analyzed frames to determine if the token set 506 has been previously detected. The previously analyzed frames may include the immediately preceding frames over a period of time (e.g., ten seconds, one minutes, or since the game has started) and/or particular frames extracted from a group of analyzed frames to reduce the amount of data storage and reduce the data processing required to perform the comparison of the key token data elements.

In the example embodiment, the image processing and analysis dedicated to token sets may be limited in scope in comparison to the image processing and analysis dedicated to players detected in captured image data, thereby enabling the systems described herein to devote computing, memory, storage, and/or other resources to enhanced player tracking capabilities and automatic association of tokens to players.

Figure 7:
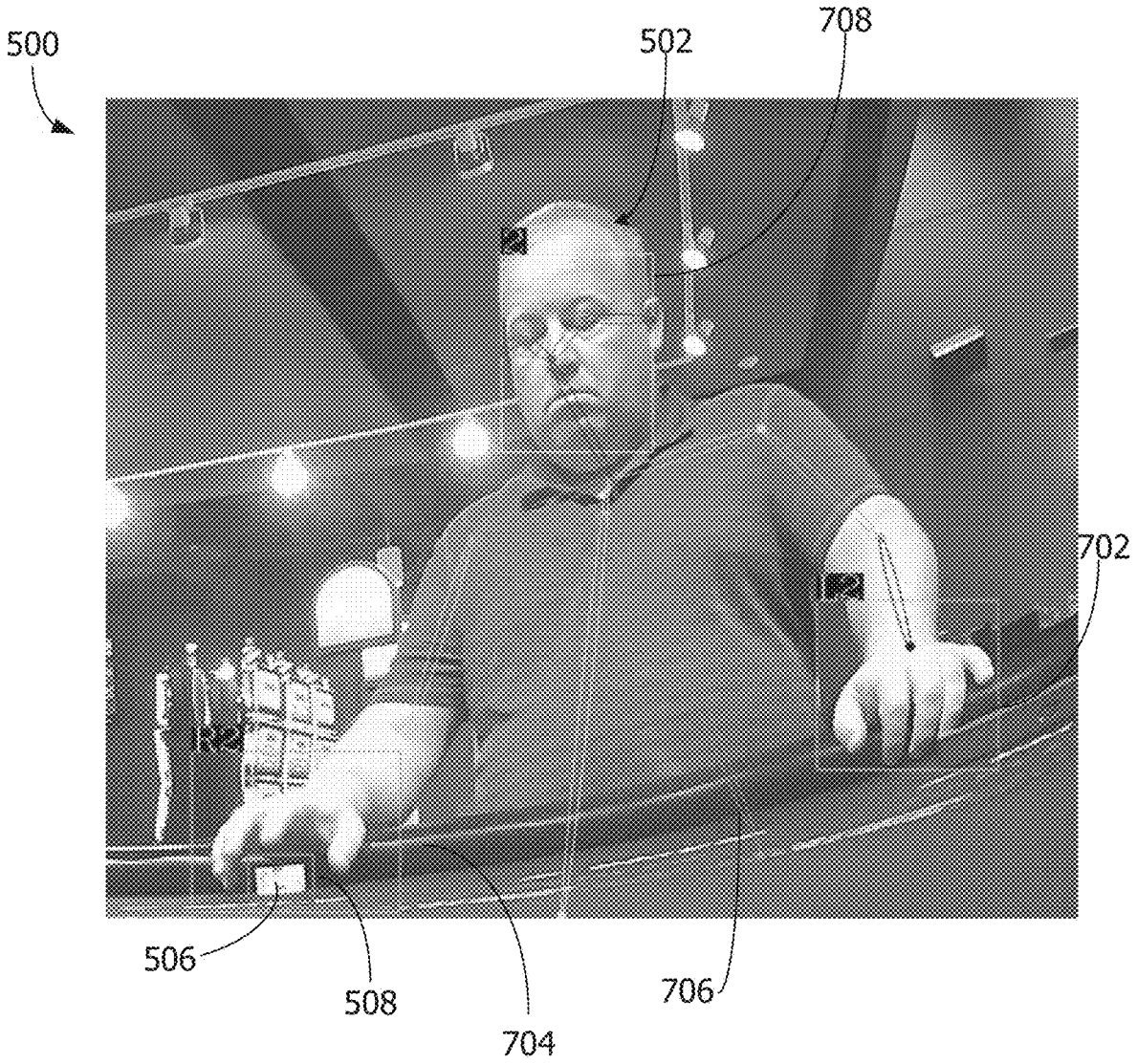
FIG. 7 is the image frame of FIG. 5 with additional player detection annotations.
Figure 8:
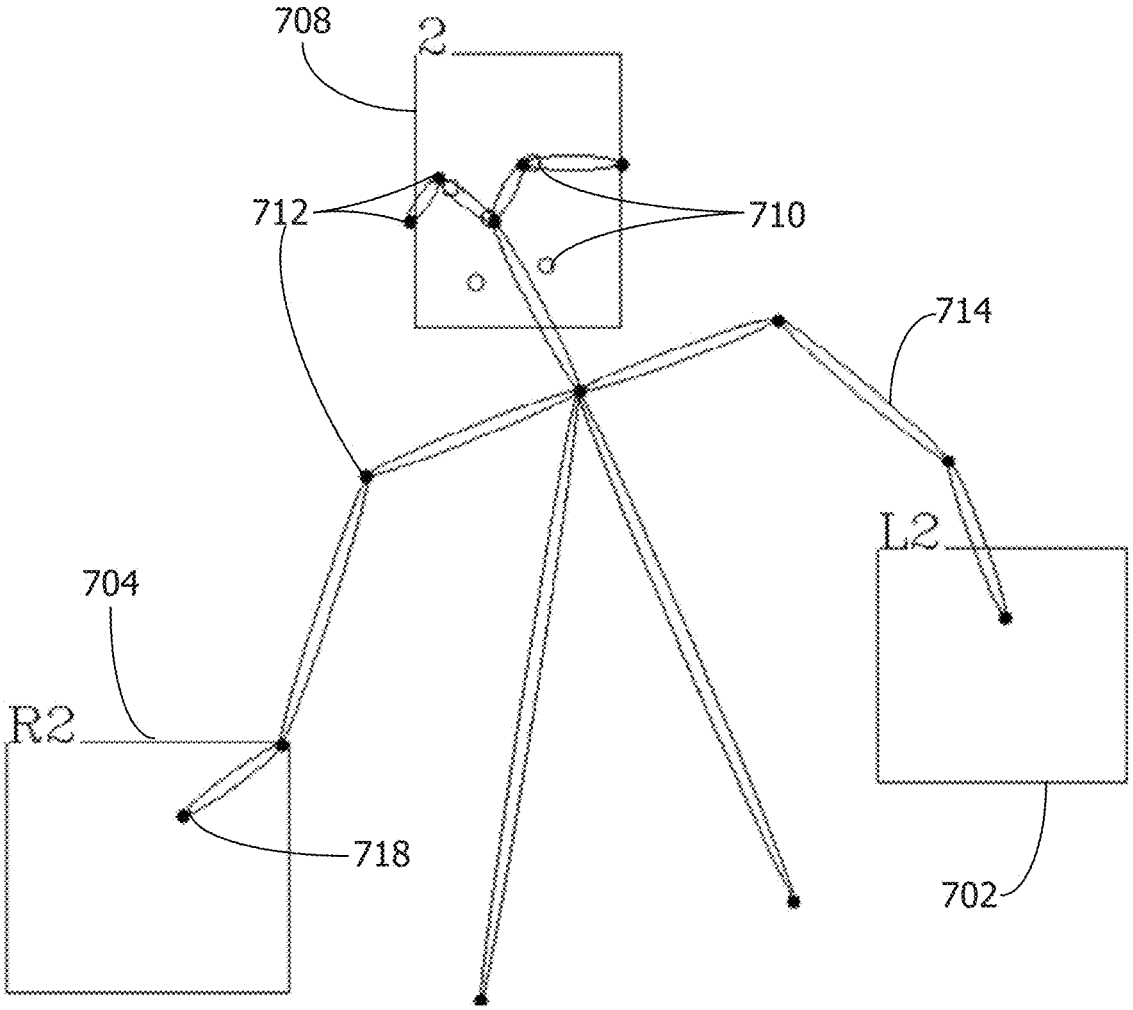
FIG. 8 is the token and player detection annotations of FIG. 7 without the underlying image frame of FIG. 5.
Figure 9:
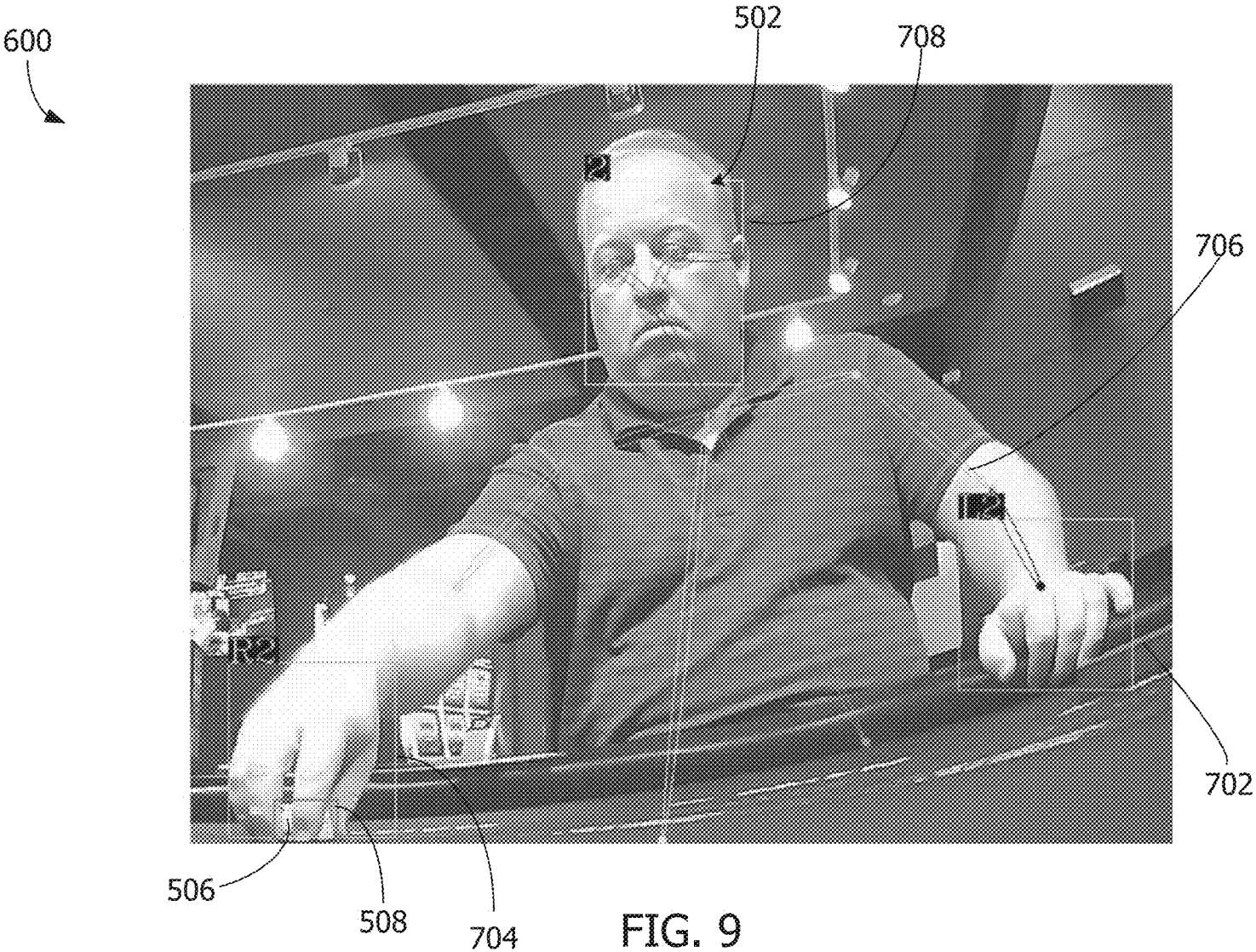
FIG. 9 is the image frame of FIG. 5 with additional player detection annotations.

FIG. 7 illustrates the frame 500 shown in FIG. 5 with the addition of several graphical representations of key player data elements. FIG. 8 illustrates the graphical representations of key player data elements without the frame 500. Similar to FIG. 7, FIG. 9 illustrates the frame 600 with the graphical representations. It is to be understood that the graphical representations shown in FIGS. 7-9 are for exemplary purposes only, and the key player data elements are not limited to the graphical representations shown.

In the example embodiment, the tracking controller 104 is configured to detect three aspects of players in captured image data: (i) faces, (ii) hands, and (iii) poses. As used herein, "pose" or "pose model" may refer physical characteristics that link together other physical characteristics of a player. For example, a pose of the player 502 may include features from the face, torso, and/or arms of the player 502 to link the face and hands of the player 502 together. The graphical representations shown include a left hand boundary box 702, a right hand boundary box 704, a pose model 706, a face or head boundary box 708, and facial feature points 710 (shown in FIG. 8).

The hand boundary boxes 702, 704, similar to token boundary box 508, are the outputs of one or more neural network models applied by the tracking controller 104. In the example embodiment, the tracking controller 104 is configured to distinguish between right and left hands (as indicated by the respective 'L' and 'R' on the hand boundary boxes 702, 704). In other embodiments, the tracking controller 104 may not distinguish between left and right hands. The classification of the hands detected in captured image data may be by default a "hand" classification and, if sufficiently identifiable from the captured image data, may further be classified into a "right hand" or "left hand" classification. As described in further detail herein, the hand boundary boxes 702, 704 may be associated with the player 502, which is illustrated by the '2' added to the hand boundary boxes 702, 704, where '2' is a player identifier of the player 502.

In the example embodiment, the pose model 706 is used to link together outputs from the neural network models to associate the outputs with a single player (e.g., the player 502). That is, the key player data elements generated by the tracking controller 104 are not associated with a player immediately upon generation of the key player data elements. Rather, the key player data elements are pieced or linked together to form a player data object as described herein. The key player data elements that form the pose model 706 may be used to find the link between the different outputs associated with a particular player.

In the example embodiment, the post model 706 includes pose feature points 712 and connectors 714. The pose feature points 712 represent key features of the player 502 that may be used to distinguish the player 502 from other players and/or identify movements or actions of the player 502. For example, the eyes, ears, nose, mouth corners, shoulder joints, elbow joints, and wrists of the player 502 may be represented by respective pose feature points 712. The pose feature points 712 may include coordinates relative to the captured image data to facilitate positional analysis of the different feature points 712 and/or other key player data elements. The pose feature points 712 may also include classification data indicating which feature is represented by the respective pose feature point 712. The connectors 714 visually link together the pose feature points 712 for the player 502. The connectors 714 may be extrapolated between certain pose feature points 712 (e.g., a connector 714 is extrapolated between pose feature points 712 representing the wrist and the elbow joint of the player 502). In some embodiments, the pose feature points 712 may be combined (e.g., via the connectors 714 and/or by linking the feature points 712 to the same player) by one or more corresponding neural network models applied by the tracking controller 104 to captured image data. In other embodiments, the tracking controller 104 may perform one or more processes to associate the pose feature points 712 to a particular player. For example, the tracking controller 104 may compare coordinate data of the pose feature points 712 to identify a relationship between the represented physical characteristics (e.g., an eye is physically near a nose, and therefore the eye and nose are determined to be part of the same player).

At least some of the pose feature points 712 may be used to link other key player data elements to the pose model 706 (and, by extension, the player 502). More specifically, at least some pose feature points 712 may represent the same or nearby physical features or characteristics as other key player data elements, and based on a positional relationship between the pose feature point 712 and another key player data element, a physical relationship may be identified. In one example described below, the pose feature points 712 include wrist feature points 716 (shown in FIG. 8) that represent wrists detected in captured image data by the tracking controller 104. The wrist feature points 716 may be compared to a plurality of hand boundary boxes 702, 704 (or vice versa such that a hand boundary box is compared to a plurality of wrist feature points 716) to identify a positional relationship with one of the hand boundary boxes 702, 704 and therefore a physical relationship between the wrist and the hand.

Figure 10:
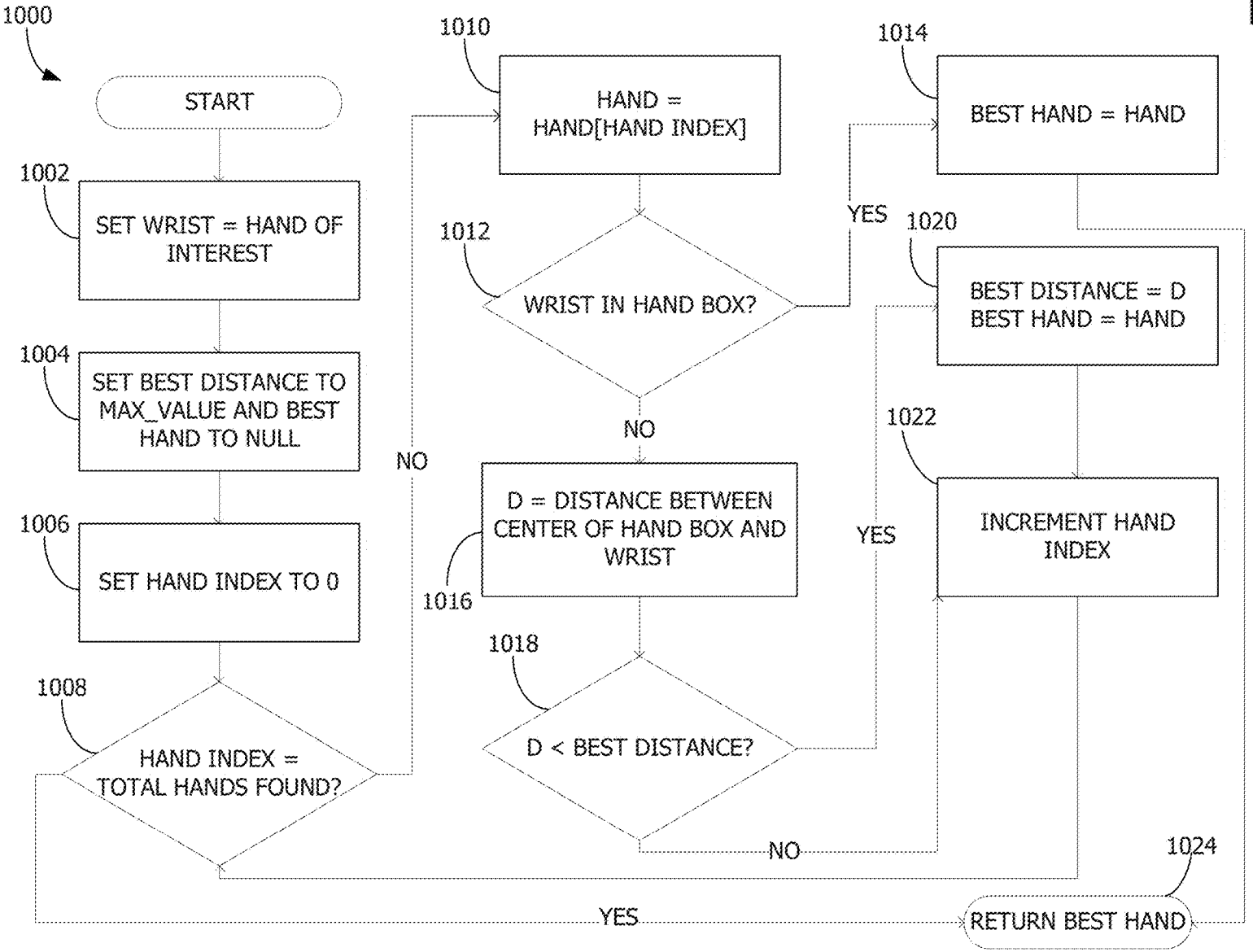
FIG. 10 is a flow diagram of an example method for linking key player data elements representing hands to a player.

FIG. 10 illustrates an example method 1000 for linking a hand boundary box to a pose model, thereby associating the hand with a particular player. The method 1000 may be used, for example, in images with a plurality of hands and poses detected to determine which hands are associated with a given pose. In other embodiments, the method 1000 may include additional, fewer, or alternative steps, including those described elsewhere herein. The steps below may be described in algorithmic or pseudo-programming terms such that any suitable programming or scripting language may be used to generate the computer-executable instructions that cause the tracking controller 104 (shown in FIG. 1) to perform the following steps. In certain embodiments, at least some of the steps described herein may be performed by other devices in communication with the tracking controller 104.

In the example embodiment, the tracking controller 104 sets 1002 a wrist feature point of a pose model as the hand of interest. That is, the coordinate data of the wrist feature point and/or other suitable data associated with the wrist feature point for comparison with key player data elements associated with hands are retrieved for use in the method 1000. In addition to establishing the wrist feature point as the hand of interest, several variables are initialized prior to any hand comparison. In the example embodiment, the tracking controller 104 sets 1004 a best distance value to a predetermined max value and a best hand variable to 'null'. The best distance and best hand variables are used in combination with each other to track the hand that is the best match to the wrist of the wrist feature point and to facilitate comparison with subsequent hands to determine whether or not the subsequent hands are better matches for the wrist. The tracking controller 104 may also set 1006 a hand index variable to '0'. In the example embodiment, the key player data elements associated with each hand within the captured image data may be stored in an array such that each cell within the hand array is associated with a respective hand. The hand index variable may be used to selectively retrieve data associated with a particular hand from the hand array.

At step 1008, the tracking controller 104 determines whether or not the hand index is equal to (or greater than, depending upon the array indexing format) the total number of hands found within the captured image data. For the initial determination, the hand index is 0, and as a result, the tracking controller 104 proceeds to set 1010 a prospective hand for comparison to the hand associated with the first cell of the hand array (in the format shown in FIG. 10, HAND[ ] is the hand array, and HAND[0] is the first cell of the hand array, where '0' is the value indicated by the HAND INDEX). In the example embodiment, the data stored in the hand array for each hand may include coordinate data of a hand boundary box. The coordinate data may a center point of the boundary box, corner coordinates, and/or other suitable coordinates that may describe the position of the hand boundary box relative to the captured image data.

The tracking controller 104 determines 1012 whether or not the wrist feature point is located within the hand boundary box of the hand from the hand array. If the wrist feature point is located with the hand boundary box, then the hand may be considered a match to the wrist and the player. In the example embodiment, the tracking controller may then set 1014 the hand as the best hand and return 1024 the best hand. The best hand may then be associated with the pose model and stored as part of the player data object of the player (i.e., the hand is "linked" to the player). Returning 1024 the best hand may terminate the method 1000 without continuing through the hand array, thereby freeing up resources of the tracking controller 104 for other functions, such as other iterations of the method 1000 for different wrist feature points and pose models. In other embodiments, the tracking controller 104 may compare the wrist feature point to each and every hand prior to returning 1024 the best hand irrespective of whether the wrist feature point is located within a hand boundary box, which may be beneficial in image data with crowded bodies and hands.

If the wrist feature point is not determined to be within the hand boundary box of the current hand, the tracking controller calculates 1016 a distance between the center of the hand boundary box and the wrist feature point. The tracking controller 104 then compares 1018 the calculated distance to the best distance variable. If the calculated distance is less than the best distance, the current hand is, up to this point, the best match to the wrist feature point. The tracking controller 104 sets 1020 the best distance variable equal to the calculated distance and the best hand to be the current hand. For the first hand from the hand array, the comparison 1018 may automatically progress to setting 1020 the best distance to the calculated distance and the best hand to the first hand because the initial best distance may always be greater than the calculated distance. The tracking controller 104 then increments 1022 the hand index such that the next hand within the hand array will be analyzed through steps 1010-1022. The hand index is incremented 1022 irrespective of the comparison 1018, but step 1020 is skipped if the calculated distance is greater than or equal to the best distance.

After each hand of the hand array is compared to the wrist feature point, the hand index is incremented to value beyond the addressable values of the hand array. During the determination 1008, if the hand index is equal to the total number of hands found (or greater than in instances in which the first value of the hand array is addressable with a hand index of '1'), then every hand has been compared to the wrist feature point, and the best hand to match the wrist feature point may be returned 1024. In certain embodiments, to avoid scenarios in which the real hand associated with a wrist is covered from view of the capture image data and the best hand as determined by the tracking controller is relatively far away from the wrist, the tracking controller 104 may compare the best distance associated with the best hand to a distance threshold. If the best distance is within the distance threshold (i.e., less than or equal to the minimum distance), the best hand may be returned 1024. However, if the best distance is greater than the distance threshold, the best hand variable may be set back to a 'null' value and returned 1024. The null value may indicate to other modules of the tracking controller 104 and/or other devices that the hand associated with the wrist is not present in the captured image data.

Figure 11:
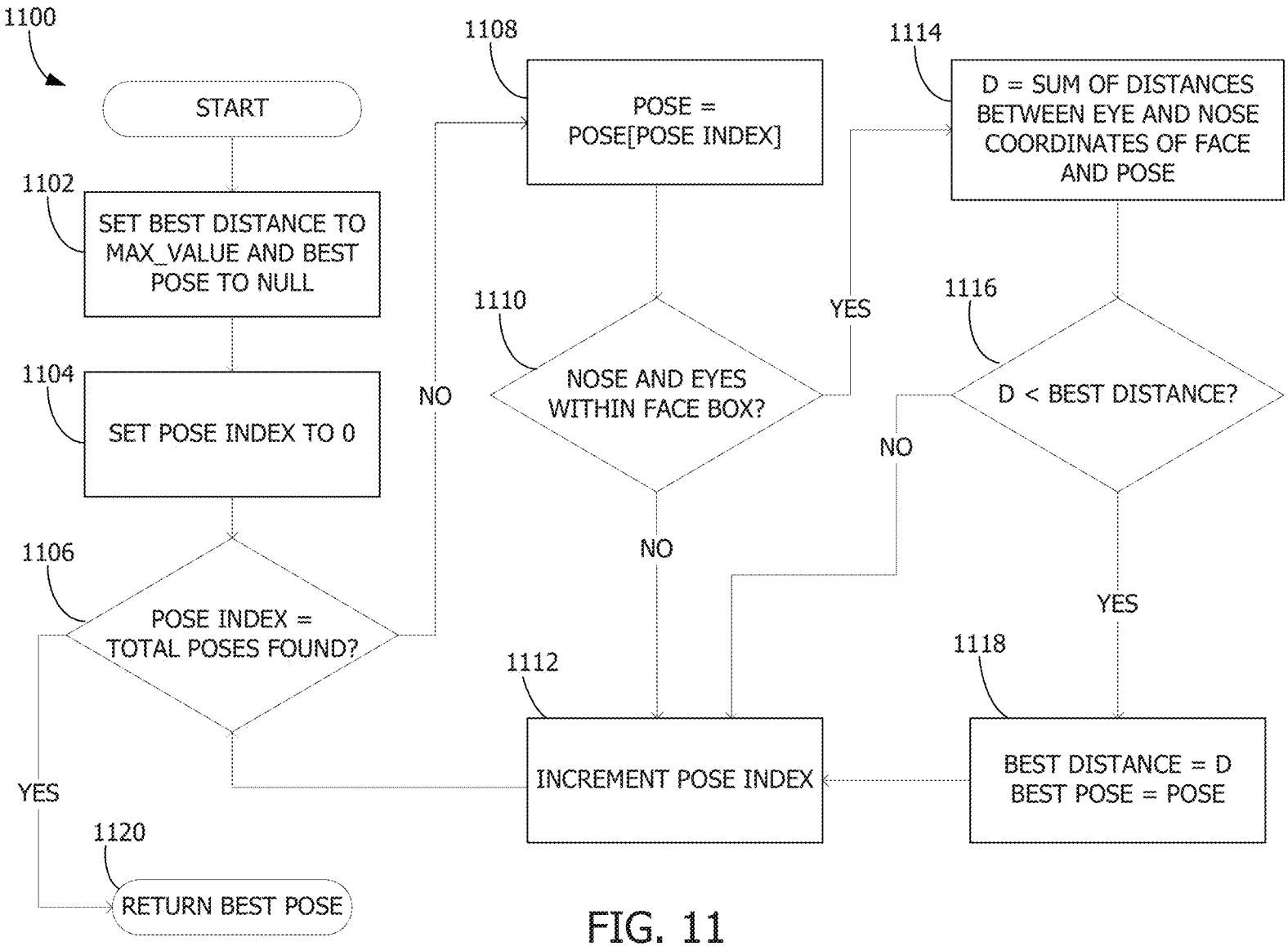
FIG. 11 is a flow diagram of an example method for linking key player data elements representing a face of a player to a corresponding body of the player.

FIG. 11 illustrates a flow diagram of an example method 1100 for linking a pose model to a particular face. The method 1100 shares some similarities to the method 1000 shown in FIG. 10, but also includes several contrasting aspects. Most notably, the method 1100 is a comparison of a plurality of pose models to a single face to identify a matching pose model for the face rather than a plurality of hands compared to a single pose model with respect to the method 1000. It is to be understood that the method 1100 may be performed using steps similar to the method 1000 (i.e., compare a single pose model to a plurality of faces), and vice versa. In other embodiments, the method 1000 may include additional, fewer, or alternative steps, including those described elsewhere herein. The steps below may be described in algorithmic or pseudo-programming terms such that any suitable programming or scripting language may be used to generate the computer-executable instructions that cause the tracking controller 104 (shown in FIG. 1) to perform the following steps. In certain embodiments, at least some of the steps described herein may be performed by other devices in communication with the tracking controller 104.

In the example embodiment, to initiate the method 1100, the tracking controller 104 may retrieve or be provided inputs associated with a face detected in captured image data. More specifically, key player data elements representing a face and/or head are used to link the face to a pose model representing a body detected in the captured image data. The key player data elements representing the face may include a face or head boundary box and/or face feature points. The boundary box and/or the face feature points may include coordinate data for identifying a location of the boundary box and/or the face feature points within the captured image data. The pose model may include pose feature points representing facial features (e.g., eyes, nose, ears, etc.) and/or physical features near the face, such as a neck. In the example embodiment, the inputs associated with the face include a face boundary box and facial feature points representing the eyes and nose of the face. Each pose includes pose feature points representing eyes and a nose and including coordinate data for comparison with the inputs of the face.

To initialize the method 1100, the tracking controller 104 sets 1102 a best distance variable to a predetermined maximum value and a best pose variable to a 'null' value. Similar to the hand array described with respect to FIG. 10, the tracking controller 104 stores data associated with every detected pose model in a pose array that is addressable via a pose array index variable. Prior to comparing the poses to the face, the tracking controller 104 sets 1104 the pose index variable to a value of '0' (or '1' depending upon the syntax of the array).

The tracking controller 104 then determines 1106 if the pose index is equal to (or greater than for arrays with an initial index value of '1') a total number of poses detected in the captured image data. If the pose index is determined 1106 not to be equal to the total number of poses, the tracking controller 104 progress through a comparison of each pose with the face. The tracking controller 104 sets 1108 the current pose to be equal to the pose stored in the pose array at the cell indicated by the pose index. For the first comparison, the current pose is stored as 'POSE[0]' according to the syntax shown in FIG. 11. The data associated with the current pose is retrieved form the pose array for comparison with the input data associated with the face.

In the example embodiment, the tracking controller 104 compares 1110 the pose feature points representing a pair of eyes and a corresponding nose to the face boundary box of the face. If the pose feature points representing the eyes and nose are not within the face boundary box, the pose is unlikely to be a match to the face, and the tracking controller 104 increments 1112 the pose index such that the comparison beginning at step 1108 begins again for the next pose. However, if the pose feature points are within the face boundary box, the tracking controller 104 then calculates 1114 a distance from the pose feature points and facial feature points. In the example embodiment, Equation 1 is used to calculate 1114 the distance D, where $\text{left_eye}_p$, $\text{right_eye}_p$, and $\text{nose}_p$ are coordinates of pose feature points representing a left eye, a right eye, and a nose of the pose model, respectively, and where $\text{left_eye}_f$, $\text{right_eye}_f$, and $\text{nose}_f$ are coordinates of facial feature points representing a left eye, a right eye, and a nose of the face, respectively.

$$D=|\text{left_eye}_p-\text{left_eye}_f|+|\text{right_eye}_p-\text{right_eye}_f|+|\text{nose}_p-\text{nose}_f| \quad (1)$$

In other embodiments, other suitable equations may be used to calculate 1114 the distance. The tracking controller 104 then compares 1116 the calculated distance to the best distance variable. If the calculated distance is greater than or equal to the best distance, the pose is determined to not be a match to the face, and the pose index is incremented 1112. However, if the calculated distance is less than the best distance, the current pose may be, up to this point, the best match to the face. The tracking controller 104 may then set 1118 the best distance to the calculated distance and the best pose variable to the current pose. For the first pose compared to the face within steps 1106-1118, the first pose may automatically be the assigned as the best pose because the of the initialized values of step 1102. The tracking controller 104 then increments 1112 the pose index to continue performing steps 1106-1118 until every pose within the pose array has been compared. Once every pose has been compared, the pose index will be equal to or greater than the total number of detected poses, and therefore the tracking controller 104 determines 1106 that the method 1100 is complete and returns 1120 the best pose to be linked to the face.

Unlike the method 1000, the method 1100 does not include steps to conclude the comparison loop (i.e., steps 1106-1118) until every pose has been compared to ensure that an early 'false positive' within the pose array does not result in the method 1100 ending without locating the best possible pose to link to the face. However, it is to be understood that the method 1100 may include additional and/or alternative steps to conclude the comparison loop without comparing every pose, particularly in embodiments in which (i) resource allocation of the tracking controller 104 may be limited due to number of parallel processes, time constraints, etc., and/or (ii) a reasonable amount of certainty can be achieved in the comparison loop that a pose is linked to the face similar to steps 1012 and 1014 in FIG. 10.

The method 1100 further includes protections against situations in which the body associated with the face is obscured from the captured image data, and the face is erroneously linked to a different pose. More specifically, the comparison 1110 requires at least some positional relationship between the pose and the face to be in consideration as the best pose to match the face. If the body associated with the face is obscured, there may not be a pose model associated with the body in the pose array. If every pose 'fails' the comparison 1110 (i.e., progressing directly to step 1112 to increment the pose index), the best pose returned 1120 by the tracking controller 104 may still be the initialized 'null' value, thereby indicating a matching pose for the face has not been detected.

The methods 1000, 1100 of FIGS. 10 and 11 may be performed at least for each newly detected pose and face, respectively, in the captured image data. That is, previously linked hands, poses, and faces may remain linked without requiring the methods 1000, 1100 to be performed again for subsequent image data. When key player data elements are generated by the tracking controller 104, the generated key player data elements may be compared to previously generated player data objects to determine (i) if new player data objects need to be generated (and the methods 1000, 1100 performed for new hands, poses, and/or faces of the generated key player data elements), and (ii) if existing data within the previously generated player data objects should be updated based at least partially on the generated key player data elements.

With respect again to FIGS. 7-9, key player data elements associated with the player 502 are generated for both the frame 500 shown in FIG. 7 and the frame 600 shown in FIG. 9. For exemplary purposes, if the frame 500 is assumed to be the initial frame in which the player 502 is detected, the key player data elements (i.e., the hand boundary boxes 702, 704, the pose model 706, the face boundary box 708, and the face feature points 710) are generated, and a player data object associated with the player 502 is generated based at least partially on the key player data elements and linking methods such as the methods 1000, 1100 shown in FIGS. 10 and 11, respectively. In this example, if the frame 600 is assumed to occur after the frame 500, then key player data elements generated for the frame 600 may be compared to the player data object to determine whether or not each key player data element is associated with the player data object (and, by extension, the player 502).

In response to determining that the new key player data elements are associated with the previously generated player data object, the tracking controller 104 may further determine if the player data object should be updated based on the new key player data elements. For example, the player 502 has moved between frame 500 and frame 600, and coordinate data of the key player data elements may be updated to reflect the positional change of the player 502 within the image data. In some embodiments, updating the player data object may result in data stored within the player data object being replaced with new data. In other embodiments, the player data object may include a historical record of changes and updates to the data stored within the player data object to facilitate historical tracking and recreation of the player. In certain embodiments, the player data object may not change, but related data generated by the tracking controller 104 (e.g., annotated image data) may be updated in response to the new key player data elements. Although the foregoing is described with respect to players and player data objects, it is to be understood that the same or similar functionality may be performed for token sets.

FIG. 12 illustrates an example method 1200 for linking a token set to a player. Linking the token set to a player may enable, for example, improved wagering and payout tracking by tracing a token set back to the original player that has introduced the token set to a gaming environment. In the example embodiment, at least a portion of the steps of the method 1200 may be performed by the tracking controller 104 (shown in FIG. 1). Other suitable devices and/or systems may perform one or more steps of the method 1200 in addition to or instead of the tracking controller 104. In other embodiments, the method 1200 may include additional, fewer, or alternative steps, including those described elsewhere herein.

In response to receiving image data of a gaming area including a token set, the tracking controller 104 generates 1202 one or more key token data elements associated with the token set. The key token data elements may facilitate distinguishing the token set from at least some other token sets. That is, the token set may not be distinguished from other token sets having the same makeup (i.e., same number of tokens, same colors, etc.), but may be at least distinguishable from other token sets having different makeups. In the example embodiment, the tracking controller 104 compares the generated key token data elements to historical key token data elements to determine 1204 whether or not the token set is associated with a previously generated token identifier. If the comparison results in a determination 1204 that the token set does not have a previously generated token identifier, the tracking controller 104 generates 1206 a token identifier for use in linking the token set to a player as described herein.

If the comparison results in a determination 1204 that the token set is associated with a token identifier, the tracking controller 104 further determines 1208 whether or not the token identifier is currently associated or linked to a player. In one example, the tracking controller 104 performs a lookup function to compare the token identifier to a plurality of player data objects that can store or be linked to one or more token identifiers. If the token identifier is already associated with a player, then the method 1200 is concluded to prevent the token set from being linked to multiple players at a time. Linking a single token set to multiple players may cause issues with attributing wagers, payouts, and other awards (e.g., player points for player accounts) to the correct player.

If the token identifier is not currently associated with a player or the tracking controller 104 generates 1206 the token identifier, the tracking controller 104 then prepares for a comparison loop similar to the method 1000, 1100 shown in FIGS. 10 and 11. In the example embodiment, the token set is compared to an array of hands similar to the hand array described with respect to FIG. 10. The tracking controller 104 initializes 1210 a hand index variable to '0' (or '1' based on the array syntax), a best hand variable to a 'null' value, and a best distance variable to a predetermined maximum distance. The tracking controller 104 then begins a comparison loop that compares each hand of the hand array with the key token data elements of the token set to determine which, if any, hand (and its corresponding player) are linked to the token set.

The tracking controller 104 determines 1212 whether or not the hand index is equal to (or greater than, depending upon array syntax) the total number of hands in the image data. If the hand index is less than the total number of hands, the current hand is set 1214 to the hand indicated in the hand array by the hand index. In the example embodiment, the hand array includes at least coordinate data of a hand boundary box for each hand, and the key token data elements include coordinate data associated with the token set. For example, the key token data elements may specify coordinates within the image data of a token boundary box or a center of the token set.

The tracking controller 104 compares the coordinate data of the current hand to the coordinate data of the token set to determine any physical relationship between the hand and the token set. In the example embodiment, the tracking controller 104 determines 1216 whether or not the token set is within the hand boundary box of the current hand based on the comparison. If the token set is within the hand boundary box, a physical relationship may be present between the hand and the token set. That is, the hand may be gripping, holding, touching, or otherwise near the token set such that possession of the token set is attributed to the hand and the corresponding player. More specifically, the best hand variable is set 1218 to the current hand, and the token identifier is linked 1220 to the player data object associated with the best hand (i.e., the current hand) to conclude the method 1200. The method 1200 may be concluded without further comparison between the token set and other hands of the hand array.

If the token set is not within the hand boundary box of the current hand, the tracking controller 104 calculates 1222 a distance between the hand and the token set. That is, in one example, the distance is calculated 1222 between a central coordinate of the hand boundary box of the current hand and a central coordinate of the token boundary box of the token set. The calculated distance is compared to the best distance variable to determine 1224 whether or not the calculated distance is less than the best distance. If the calculated distance is determined 1224 to be less than the best distance, the best hand is set 1226 to the current hand and the best distance is set to the calculated distance for comparison with subsequent hands of the hand array. Irrespective of the determination 1224, the tracking controller 104 increments 1228 the hand index to retrieve the next hand of the hand array for the comparison loop (i.e., steps 1212-1228).

If the hand index is incremented to equal the total number of hands, every hand in the hand array has been compared, and the tracking controller 104 progresses from the determination 1212 to link 1220 the token identifier to the player data object associated with the best hand from the hand array. In certain embodiments, additional steps may be performed to prevent token sets that are not associated with any player to be erroneously associated with a player. More specifically, the tracking controller 104 may compare the best distance to a distance threshold prior to linking 1220 the token identifier to a player data object. If the best distance is less than or equal to the distance threshold, the token identifier is linked 1220 to the player data object. However, if the best distance is greater than the distance threshold, the tracking controller 104 may prevent the token identifier from being linked 1220 to the player data object.

In certain embodiments, the comparison loop (steps 1212-1228) may be reduced to reduce the resource burden and/or speed of the method 1200. For example, steps 1222-1226 may be removed from the method 1200 such that the token set is linked to a hand only if the token set is determined 1216 to be within a hand boundary box of the hand. In another example, the determination 1216 and step 1218 may be removed from the method 1200.

As mentioned previously, token identifiers may be linked to player data objects on a temporary basis because token sets may be dynamically created, changed, or otherwise removed both inside and out of the gaming environment. In the example embodiment, the token set may be linked to a player for a period of time and/or a period of inactivity. The period of time may be an hour or a round of the game conducted at the gaming table. In one example, wagers are placed at the gaming table for a round of the game, and payouts for the round may be distributed using tokens from the token set such that token sets of the wagers are redistributed to players and new token sets may be formed. In such an example, new token identifiers may be applied after each round of player. A period of inactivity may be defined as a period in which the token set is not used within the game or a period in which the token set is not detected in image data. In certain embodiments, a historical record of token identifiers may be stored with each player data object such that a timeline of the player or certain tokens (e.g., counterfeit tokens) may be traced over time.

Figure 13:
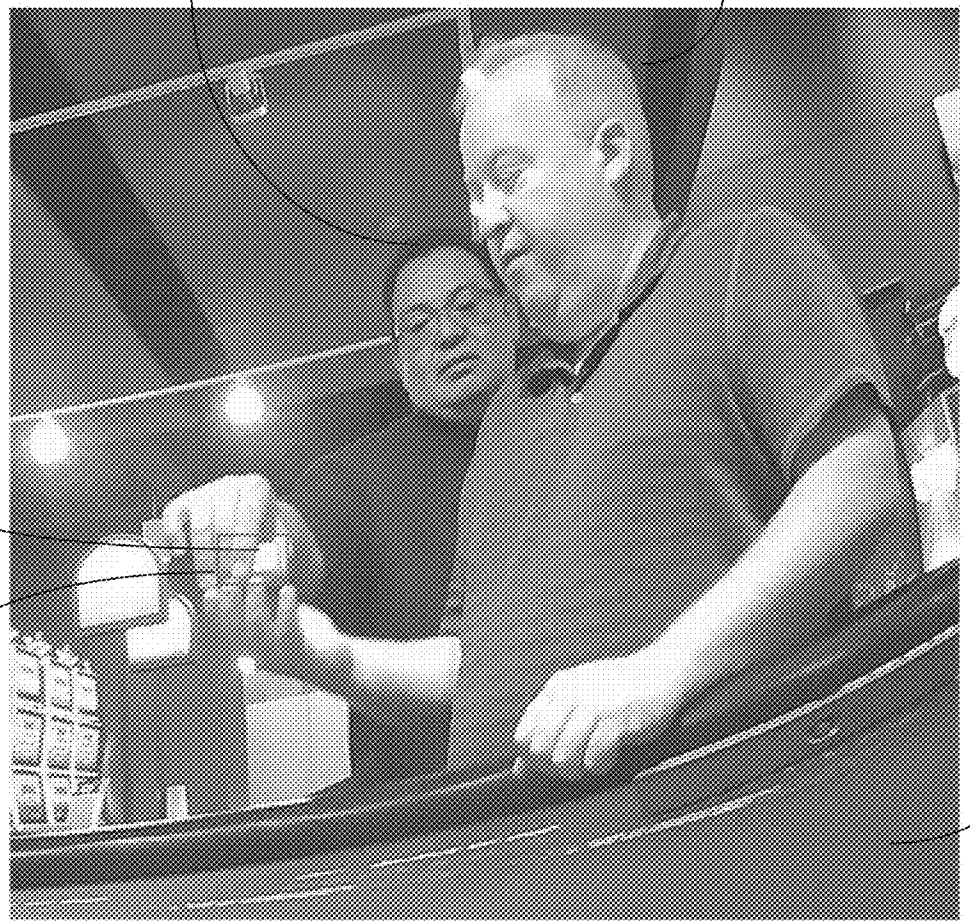
FIG. 13 is an example image frame of a back player passing a token set to an active player for placing a wager at a gaming table.
Figure 14:
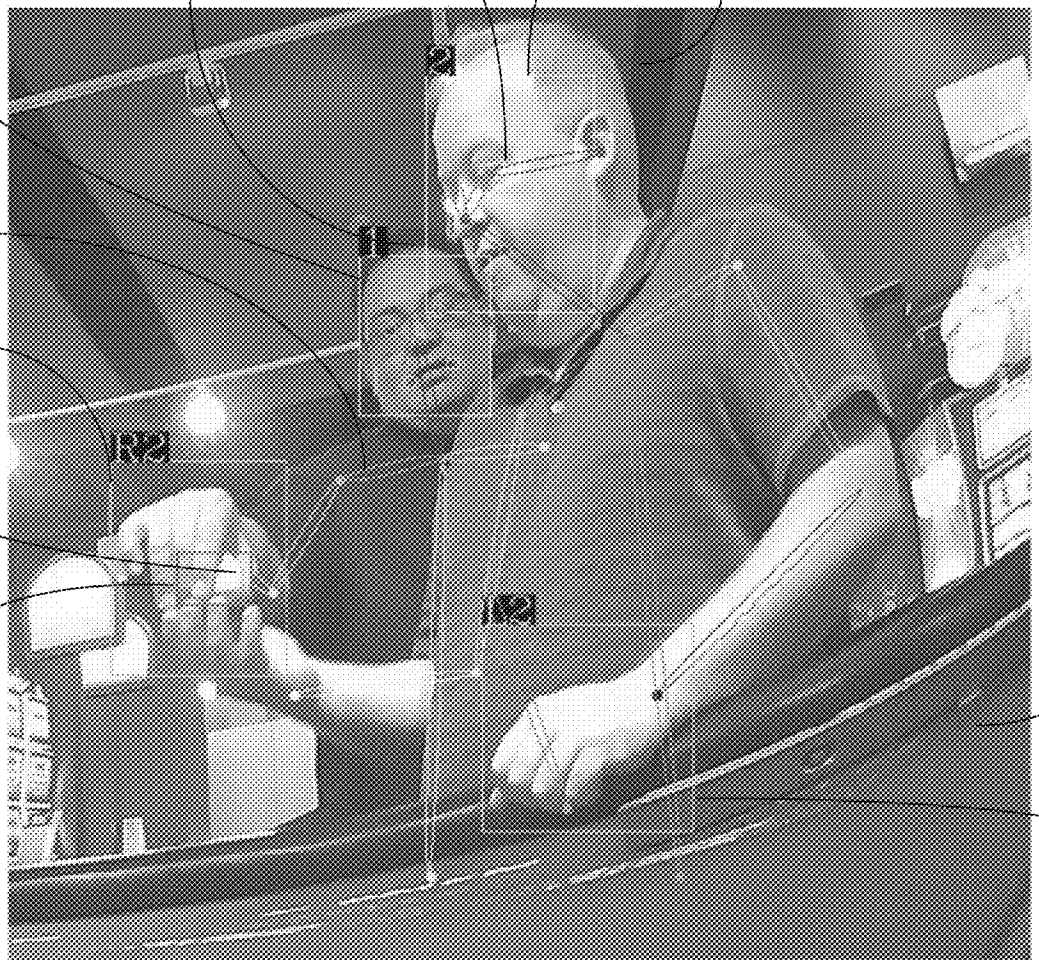
FIG. 14 is the image frame of FIG. 13 with additional player detection annotations.
Figure 15:
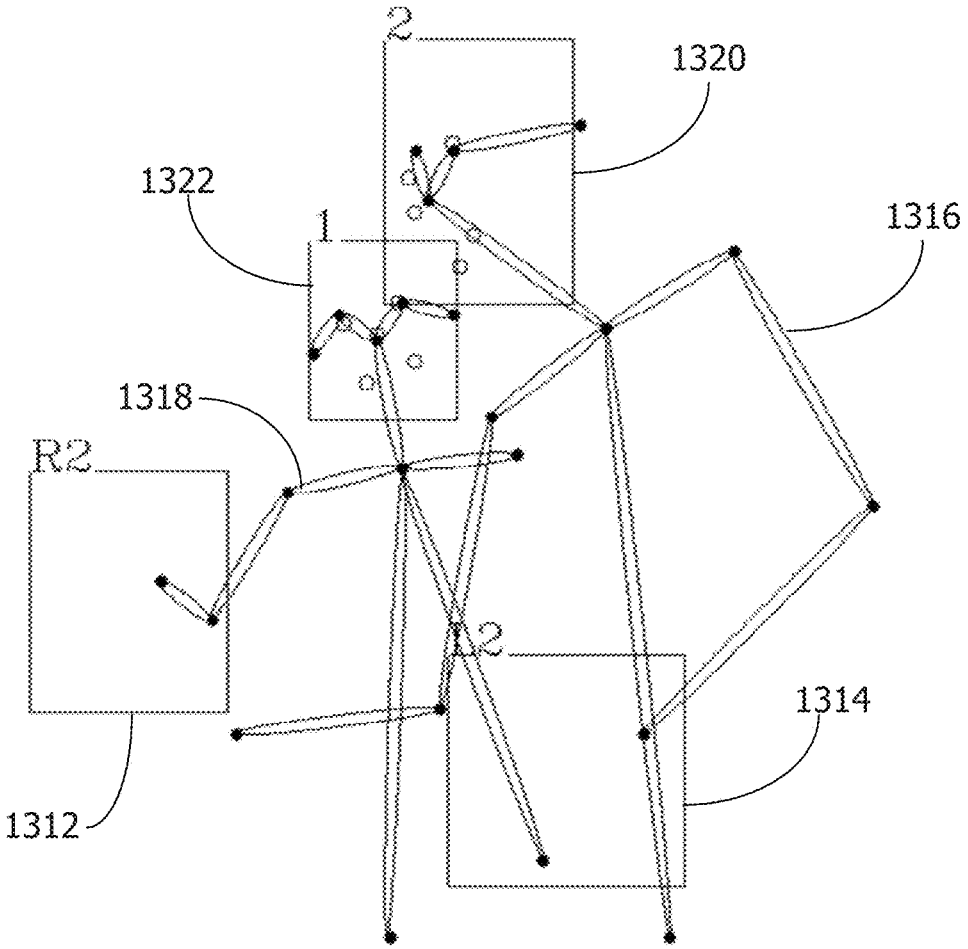
FIG. 15 is the player detection annotations of FIG. 14 without the underlying image frame.

FIGS. 13-15 illustrate an example frame 1300 depicting a back player 1302 passing a token set 1304 to an active player 1306 for placing a wager at a gaming table 1308. FIG. 13 depicts the frame 130 without image processing of the players 1302, 1306, FIG. 14 depicts the frame 1300 with player-focused image processing, and FIG. 15 depicts the graphical outputs of image processing on the frame 1300.

With respect to FIGS. 13-15, in the example embodiment, the token set 1304 is associated with a token boundary box 1310 representing one or more key token data elements generated by the tracking controller 104 (shown in FIG. 1) by applying one or more neural network models to the frame 1300. The key player data elements generated by the tracking controller 104 are represented by hand boundary boxes 1312, 1314, a first pose model 1316, a second pose model 1318, a first face boundary box 1320, and a second face boundary box 1322 (each shown in FIGS. 14 and 15). The scenario shown in the frame 1300 and the resulting generated key data elements depict several aspects of the system 100 (shown in FIG. 1) automatically adapting to a dynamic environment over time.

The frame 1300 depicts the active player 1306 turning away from the gaming table 1308 and towards the back player 1302. The right hand of the back player 1302 is gripping the token set 1304 from above and is extended towards the active player 1306 to be deposited in the right hand of the active player 1306. Subsequent to the frame 1300, in this example, the active player 1306 then takes the token set 1304 from the back player 1302 and deposits the token set 1304 on the gaming table 1308 to indicate a wager placed by the back player 1302 on the game conducted at the gaming table 1308. The exchange between the back player 1302 and the active player 1306 may be necessitated due to the back player 1302 having limited access to the gaming table 1308 himself or herself (e.g., other players blocking the back player 1302 from accessing the gaming table 1308, etc.).

Within the frame 1300, the back player 1302 is partially obscured by the active player 1306, thereby limiting the amount of key player data elements generated for the back player 1302 relative to the amount of key player data elements generated for the active player 1306. However, the reduced amount of key player data elements may not prevent the player data object associated with the back player 1302. Rather, if subsequent frames reveal more the back player 1302, the player data object may be updated to include the additional key player data elements generated by the tracking controller 104.

In the example embodiment, at least one neural network of the tracking controller 104 may be in a partially trained state that is not configured yet to recognize the exchange between the players 1302, 1306. That is, due to the proximity and differing orientations of the hands exchanging the token set 1304, the tracking controller 104 does not identify the right hand of the active player 1306 (evidenced in the frame 1300 by the absence of a hand boundary box encapsulating the hand), and the tracking controller 104 attributes the right hand of the back player 1302 to the active player 1306, where 'R2' indicates the hand is a right hand of a player with the player identifier of '2'.

In this example, the generated key player data elements and the graphical representations shown indicate the tracking controller 104 (and the underlying neural networks) have undergone a training process in which training data (i.e., inputs with known outputs) is processed through the neural networks, and error correction is performed to tune the neural networks to correctly identify particular objects, such as hands and token sets. However, in a dynamic environment such as a gaming environment, situations may arise that the training process has not fully prepared the tracking controller 104 to recognize. To adapt to these situations, the feedback loop nature of the neural networks may be harnessed to identify errors, perform error correction, and, in response to persistent error correction, begin to identify the previously unidentified or misidentified objects. For example, subsequent frames may reveal to the tracking controller 104 that the hand attributed to the active player 1306 is in fact a hand of the back player 1302, and the right hand of the active player 1306 may be detected. The tracking controller 104 may perform error correction with respect to the outputs associated with the frame 1300 within the neural network models to attempt to reduce errors in similar, subsequent situations. The automated nature of the feedback loop of the neural network models, in combination with thorough and extensive training, may enable the system to provide robust and adaptable object detection, classification, and interaction within image data of a gaming environment.

The exchange shown in the frame 1300 may create problems in existing tracking systems for linking players and tokens together. More specifically, table-based tracking systems (i.e., sensors embedded into the gaming table 1308) may not be able to accurately attribute a token set placed on the gaming table 1308 due to limitations such as limited table indicia to distinguish between players or an inability to identify and track back players, particularly when the token sets of the back players may be passed to an intermediate player prior to placement on the gaming table 1308. A dealer monitoring the gaming table 1308 and players participating in the game may be performing several duties at once to conduct the game, and thus may be limited in his or her ability to correctly attribute and track token sets to players (particularly in situations in which the dealer enters the wagers into a system for tracking historical wagering, gameplay, and payouts).

As described with respect to FIG. 12, the tracking controller 104 may be configured to prevent the token set 1304 from being incorrectly attributed to intermediate players by locking the token identifier to an originating player. For example, if the token set 1304 is captured in image data prior to the frame 1300 and is determined to be possessed by the back player 1302 (e.g., the image data shows the back player 1302 holding the token set 1304), then the token identifier of the token set 1304 is linked to the player data object of the back player 1302. When the exchange occurs in the frame 1300 and afterwards in frames in which the active player 1306 is holding the token set 1304, methods such as the method 1200 shown in FIG. 12 prevent the token set from being linked to the active player 1306 (e.g., see the progression in the method 1200 from step 1202 to step 1204 to step 1208 at which the method 1200 is concluded after it is determined the token identifier is associated with a player data object).

Other suitable techniques may be employed by the tracking controller 104 in addition to or in place of the technique described in FIG. 12. For example, the token set 1304 may not be visible until the frame 1300 in which possession may be not determined from prior frames. In such an example, the link between the token set and one of the players 1302, 1306 may be temporary until the tracking controller 104 can identify the owner based on subsequent frames. The tracking controller 104 may identify the back player 1302 as the owner of the token set 1304 because of the motion of the back player 1302 and/or the active player 1306 as indicated at least by the pose models 1316, 1318. In another example, the tracking controller 104 may be configured to receive user input from a dealer to confirm and/or correct links between wagers and players.

The ownership of the token set 1304 may be temporary to account for ownership changes and/or changes to the composition of the token set itself 1304. That is, payouts the redistribute wagered token sets or adding or removing tokens from the token set 1304 may result in new links to be formed between the resulting token sets and the players. The link between the token sets and players may be automatically removed in response to one or more events, such as conclusion of a payout process for a round of the game conducted at the gaming table 1308 or one or more outcomes of the game, and/or may be terminated in response to expiration of a period of time and/or a period of inactivity.

The foregoing systems and methods describe player and token tracking within gaming environments that may be adaptable to the dynamic nature of the environment. It is to be understood that other suitable items or people may to detected, tracked, and/or linked to other detected objects. For example, game pieces that are not used to represent wagers may be tracked and linked to players in a fashion similar to the token sets described above.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A system for tracking players and tokens in a casino gaming environment, the system comprising:

at least one image sensor configured to capture image data of a gaming table and a player area associated with the gaming table; and a tracking controller communicatively coupled to the at least one image sensor to receive the captured image data, the tracking controller configured to:

detect a player occupying the player area and a token set from the captured image data at least by applying at least one image neural network model to the captured image data to generate at least one key player data element for the player and to generate at least one key token data element for the token set;

generate a player data object representing physical characteristics of the player based on the at least one key player data element;

link the player data object to a player identifier associated with the player;

generate a token identifier for the detected token set based on the at least one key token data element;

link the token identifier to the player data object based on a physical relationship between the player and the token set indicated by the at least one key player data element and the at least one key token data element;

detect that the token set is associated with a winning outcome of a game conducted at the gaming table;

based on the link between the token identifier and the player data object, retrieve player identification associated with the player for receiving a payout for the winning outcome, the player identification including at least one of the player identifier, an image of the player, or a player name associate with the player; and cause an external interface in communication with the tracking controller to display the retrieved player identification to verify the player as the recipient of the payout.

2. The system of claim 1, wherein the tracking controller is configured to:

compare the at least one key player data element to historical player data stored by a player tracking database in communication with the communication device of the tracking controller;

in response to the comparison identifying historical player data associated with the player, retrieve the player identifier from the identified historical player data; and in response to the comparison indicating an absence of historical player data associated with the player, generate the player identifier.

3. The system of claim 2, wherein, in response to the comparison indicating the absence of historical player data associated with the player, the generated player identifier is temporarily associated with the player until expiration of at least one of a predetermined period of time or a predetermined period of inactivity.

4. The system of claim 1, wherein the at least one key player data element includes one or more key player data elements representing a hand of the player and indicating a position of the hand, and wherein the physical relationship between the player and the token set is indicated by a proximity between the position of the hand indicated by the one or more key player data elements and a position of the token set indicated by the one or more key token data elements.

5. The system of claim 1, wherein the tracking controller is configured to:

detect a second player occupying the player area from the captured image data by applying at least one image neural network model to the captured image data to generate at least one key player data element associated with the second player;

compare the at least one key player data element associated with the second player to historical player data stored by a tracking database;

in response to the at least one key player data element associated with the second player matching a stored player data object and player identifier associated with the second player, retrieve the stored player data object; and in response to the absence of historical player data matching the at least one key player data element associated with the second player, generate a second player data object associated with the second player based on the at least one key player data element associated with the second player.

6. The system of claim 1, wherein the token identifier remains linked to the player data object associated with the player irrespective of physical relationships between the token set and intermediary players indicated by subsequent image data from the image sensor until at least the player identification is retrieved.

7. A method for tracking players and tokens in a casino gaming environment, the method comprising:

capturing, by an image sensor, image data of a gaming table and a player area associated with the gaming table;

receiving, by a tracking controller, the captured image data from the image sensor;

detecting, by the tracking controller, a player occupying the player area and a token set from the captured image data at least by applying at least one image neural network model to the captured image data to generate at least one key player data element for the player and to generate at least one key token data element for the token set;

generating a player data object representing physical characteristics of the player based on the at least one key player data element;

linking, by the tracking controller, the player data object to a player identifier associated with the player;

generating, by the tracking controller, a token identifier for the detected token set based on the at least one key token data element;

linking, by the tracking controller, the token identifier to the player data object based on a physical relationship between the player and the token set indicated by the at least one key player data element and the at least one key token data element;

detecting, by the tracking controller, that the token set is associated with a winning outcome of a game conducted at the gaming table;

retrieving, by the tracking controller and based on the link between the token identifier and the player data object, player identification associated with the player for receiving a payout for the winning outcome, the player identification including at least one of the player identifier, an image of the player, or a player name associate with the player; and causing, by the tracking controller, an external interface in communication with the tracking controller to display the retrieved player identification to verify the player as the recipient of the payout.

8. The method of claim 7, wherein linking the player data object to the player identifier associated with the player comprises:

comparing, by the tracking controller, the at least one key player data element to historical player data stored by a player tracking database;

in response to the comparison identifying historical player data associated with the player, retrieving the player identifier from the identified historical player data; and in response to the comparison indicating an absence of historical player data associated with the player, generating the player identifier.

9. The method of claim 7, wherein the at least one image neural network model includes a first image neural network model configured to generate a first set of key player data elements representing a first physical characteristic of the player and a second neural network model configured to generate a second set of key player data elements representing a second physical characteristic, and wherein generating the player data object includes linking the first set and the second set of key player data elements to the player data object based on a physical proximity between the first physical characteristic and the second physical characteristic, the physical proximity represented by the first set of key player data elements and the second set of key player data elements.

10. The method of claim 9, wherein the first set of key player data elements represents a face of the player having a first position in the captured image data and the second set of key player data elements represents a torso of the player having a second position in the captured image, and wherein the first set and the second set are linked together based on the proximity of the first position and the second position.

11. The method of 7, wherein the physical characteristics represented by the player data object include at least one of a face, a head, a limb, an extremity, or a torso, the player data object including position data for the represented physical characteristics.

12. The method of claim 7 further comprising:

receiving, by the tracking controller subsequent image data from the image sensor;

detecting, by the tracking controller, the player is present in the subsequent image data;

applying, by the tracking controller, the at least one image neural network model to the subsequent image data to generate at least one updated key player data element; and replacing, by the tracking controller, one or more key player data elements of the player data object associated with the player with the at least one updated key player data element.

13. The method of claim 7, wherein the player data object includes location data indicating the player is present at the gaming table, and wherein, in response to the player being absent from subsequent image data captured by the image sensor, the tracking controller removes the location data from the player data object.

14. A tracking controller for a casino gaming environment, the tracking controller comprising:

a communication device communicatively coupled to an image sensor configured to capture image data of a gaming table and a player area associated with the gaming table;

at least one processor; and a memory device communicatively coupled to the at least one processor, the memory device configured to store computer-executable instructions that, when executed by the at least processor, cause the tracking controller to:

detect a player occupying the player area and a token set from the captured image data at least by applying at least one image neural network model to the captured image data to generate at least one key player data element for the player and to generate at least one key token data element for the token set;

generate a player data object representing physical characteristics of the player based on the at least one key player data element;

link the player data object to a player identifier associated with the player;

generate a token identifier for the detected token set based on the at least one key token data element;

link the token identifier to the player data object based on a physical relationship between the player and the token set indicated by the at least one key player data element and the at least one key token data element;

detect that the token set is associated with a winning outcome of a game conducted at the gaming table;

based on the link between the token identifier and the player data object, retrieve player identification associated with the player for receiving a payout for the winning outcome, the player identification including at least one of the player identifier, an image of the player, or a player name associate with the player; and cause an external interface in communication with the tracking controller to display the retrieved player identification to verify the player as the recipient of the payout.

15. The tracking controller of claim 14, wherein the computer-executable instructions cause the tracking controller to:

compare the at least one key player data element to historical player data stored by a player tracking database in communication with the communication device of the tracking controller;

in response to the comparison identifying historical player data associated with the player, retrieve the player identifier from the identified historical player data; and in response to the comparison indicating an absence of historical player data associated with the player, generate the player identifier.

16. The tracking controller of claim 15, wherein, in response to the comparison indicating the absence of historical player data associated with the player, the generated player identifier is temporarily associated with the player until expiration of at least one of a predetermined period of time or a predetermined period of inactivity.

17. The tracking controller of claim 14, wherein the computer-executable instructions cause the tracking controller to:

detect a second token set within the captured image data, the second token set having a second token identifier and at least one key token data elements;

detect a physical relationship between the player and the second token set based at least partially on the at least one key player data elements and the at least one key token data elements of the second token set;

compare the second token identifier to a plurality of player data objects associated with a plurality of players at the gaming table; and prevent the second token identifier from being linked to the player data object of the player in response to the comparison identifying a different player data object of the plurality of player data objects linked to the second token identifier.

18. The tracking controller of claim 14, wherein the token identifier is unlinked from the player data object in response to one or more outcomes of a game conducted at the gaming table.

19. The tracking controller of claim 14, wherein the physical characteristics represented by the player data object include at least one of a face, a head, a limb, an extremity, or a torso, the player data object including position data for the represented physical characteristics.

* * * * *